US008181500B2

(12) United States Patent
Hiramoto et al.

(10) Patent No.: US 8,181,500 B2
(45) Date of Patent: May 22, 2012

(54) DIE FOR EXTRUSION MOLDING OF METAL MATERIAL

(75) Inventors: Kimihisa Hiramoto, Oyama (JP); Hidekazu Sakihama, Oyama (JP)

(73) Assignee: Showa Denko K.K., Tokyo (JP)

( * ) Notice: Subject to any disclaimer, the term of this patent is extended or adjusted under 35 U.S.C. 154(b) by 393 days.

(21) Appl. No.: 12/525,313

(22) PCT Filed: Jan. 10, 2008

(86) PCT No.: PCT/JP2008/050204
§ 371 (c)(1),
(2), (4) Date: Jul. 31, 2009

(87) PCT Pub. No.: WO2008/093524
PCT Pub. Date: Aug. 7, 2008

(65) Prior Publication Data

US 2010/0107716 A1 May 6, 2010

(30) Foreign Application Priority Data

Jan. 31, 2007 (JP) ..... 2007-020339
Mar. 7, 2007 (JP) ..... 2007-056841

(51) Int. Cl.
*B21C 23/04* (2006.01)

(52) U.S. Cl. ..... 72/264; 72/269

(58) Field of Classification Search ..... 72/253.1, 72/264, 268, 269, 271, 467
See application file for complete search history.

(56) References Cited

U.S. PATENT DOCUMENTS 2,276,468 A * 3/1942 Couchman ..... 72/269
2,366,344 A * 1/1945 McFadden ..... 72/269
2,673,645 A * 3/1954 Moczik ..... 72/264
2,971,644 A * 2/1961 Sejournet ..... 72/43
3,080,051 A * 3/1963 Muller ..... 72/268

(Continued)

FOREIGN PATENT DOCUMENTS

JP 49 46707 12/1974

(Continued)

OTHER PUBLICATIONS

U.S. Appl. No. 12/307,836, filed Apr. 23, 2009, Hiramoto, et al.

(Continued)

*Primary Examiner* — Edward Tolan
*Assistant Examiner* — Lawrence J Averick
(74) *Attorney, Agent, or Firm* — Oblon, Spivak, McClelland, Maier & Neustadt, L.L.P.

(57) ABSTRACT

A die 10 has a die case 20 arranged with a pressure receiving surface 22 of a pressure receiving portion 21 facing rearward so as to oppose to an extrusion direction, a male die 30 and a female die 40 mounted in the die case 20. The pressure receiving portion 22 is formed into a rearwardly protruded convex shape. A plurality of metal material introducing portholes 24 are formed in an external periphery of the pressure receiving portion 21. It is configured such that the metal material pressed against the pressure receiving surface 22 is introduced into the die case 20 via the portholes 24 and passes through the extrusion hole 11. B/A is adjusted to 1.8 to 6.0 and D/B is adjusted to 0.15 to 0.4, where "A" is a product circumscribed circle diameter, "B" is a pressure receiving surface external diameter, "C" is a between-hole-wall inlet side minimum thickness size, "n" is the number of the between-hole-walls, and "D" is a between-hole-wall inlet side total thickness size obtained by "C"×"n."

17 Claims, 14 Drawing Sheets

U.S. PATENT DOCUMENTS

| | | | | | |
|---|---|---|---|---|---|
| 3,112,828 | A | * | 12/1963 | Zipf | 72/253.1 |
| 3,126,096 | A | * | 3/1964 | Gerard et al. | 72/253.1 |
| 3,203,215 | A | * | 8/1965 | Jones | 72/253.1 |
| 3,306,089 | A | * | 2/1967 | Brayman | 72/56 |
| 3,343,388 | A | * | 9/1967 | Zeitlin et al. | 72/56 |
| 3,364,707 | A | * | 1/1968 | Foerster | 72/38 |
| 3,748,885 | A | * | 7/1973 | Creuzet | 72/269 |
| 4,030,334 | A | * | 6/1977 | Wagner et al. | 72/258 |
| 4,976,130 | A | * | 12/1990 | Oki et al. | 72/269 |
| 5,061,163 | A | * | 10/1991 | Kennedy | 425/79 |
| 5,263,352 | A | * | 11/1993 | Yano | 72/269 |
| 5,337,593 | A | * | 8/1994 | Yano | 72/269 |
| 5,664,453 | A | * | 9/1997 | Abo et al. | 72/269 |
| 5,813,269 | A | * | 9/1998 | Yano | 72/261 |
| 5,832,768 | A | * | 11/1998 | Yano | 72/269 |
| 7,093,474 | B2 | * | 8/2006 | Hiramoto et al. | 72/269 |
| 2010/0199738 | A1 | * | 8/2010 | Nolting | 72/264 |

FOREIGN PATENT DOCUMENTS

| | | | |
|---|---|---|---|
| JP | 53-102938 | U | 8/1978 |
| JP | 6 81644 | | 10/1994 |

OTHER PUBLICATIONS

U.S. Appl. No. 12/443,700, filed Mar. 31, 2009, Hiramoto, et al.

* cited by examiner

PRIOR ART

DIE FOR EXTRUSION MOLDING OF METAL MATERIAL

TECHNICAL FIELD

The present invention relates to an extrusion molding die for metal material for use in extruding metal material, and its related art.

BACKGROUND ART

As an extrusion molding die for use in manufacturing a metallic hollow extrusion molded product, such as, e.g., an aluminum heat exchanging tube for use in car air-conditioning heat exchangers, there are a die called a porthole die as shown in FIG. 18A, a die called a spider die as shown in FIG. 18B, or a die called a bridge die as shown in FIG. 18C.

In these extrusion molding dies, a male die 1 and a female die 2 are combined so that the mandrel 1*a* of the male die 1 is disposed in the corresponding die hole 2*a* of the female die 2 to define a circular extrusion hole by and between the mandrel 1*a* and the die hole 2*a*. In the die, it is configured such that a metal billet (metal material) pressed against the billet pressure receiving surface (metal material pressure receiving surface 1*b*) of the male die 1 is introduced in both the dies 1 and 2 via material introduction holes 1*c* and then passes through the extrusion hole while being plastically deformed, so that an extrusion molded article having a cross-section corresponding to the cross-sectional configuration of the extrusion hole is formed.

In such extrusion molding dies, large stress due to pressing of the metal billet is applied to the billet pressure receiving surface 1*b* of the male die 1, causing generation of cracks in the periphery of the pressure receiving portion of the die by the stress, which may sometimes make it difficult to attain sufficiently long die life.

Under the circumstances, conventionally, extrusion molding dies for metal material as disclosed by the below-listed Patent Documents 1 and 2 have been conventionally proposed. In the dies, it is configured such that the billet pressure receiving surface of the male die is formed into a convex configuration protruded in a direction opposite to the billet extruding direction (i.e., protruded rearward) so that the pressing force of the metal billet to be applied to the billet pressure receiving surface can be received by a bridge portion of the male die.

Patent Document 1: Japanese Unexamined Laid-open Utility Model Publication No. S53-102938 (see claims, FIGS. 3 to 5)

Patent Document 2: Japanese Examined Laid-open Patent Publication No. H06-81644 (see claims, and drawings)

DISCLOSURE OF THE INVENTION

Problems to be Solved by the Invention

In the conventional extrusion molding dies disclosed in the aforementioned Patent Documents 1 and 2, although the strength of the male die such as the pressure resistance against a metal billet can be improved to some degree since the billet pressure receiving surface is formed into a convex configuration, the bridge portion is still weak in strength. Therefore, in order to secure sufficient strength of the bridge portion, it is inevitable to increase the size, e.g., thickness of the bridge portion of the male die, which causes not only increase in size and weight but also increase in cost.

Furthermore, in the extrusion molding die, especially in the case of performing extrusion molding of a complicated configuration, it is required to smoothly introduce the metal material from the material introduction portion of the male die to the extrusion hole in a stable manner. In the aforementioned extrusion molding die, however, the metal material to be flowed from the material introduction portion into between the male die and the female die is disturbed by the bridge portion of the male die, preventing smooth introduction of the metal material. This may deteriorate the dimensional accuracy of the extrusion molded article (extrusion molded product) to cause difficulty in obtaining high quality.

The preferred embodiments of the present invention have been developed in view of the above-mentioned and/or other problems in the related art. The preferred embodiments of the present invention can significantly improve upon existing methods and/or apparatuses.

The main purpose of the present invention is to solve the aforementioned problems of the prior arts and provide an extrusion molding die for metal material capable of attaining cost reduction and size reduction and also obtaining high quality extrusion molded article (extrusion molded product) while keeping sufficient strength and durability of the die.

Other purposes of the present invention is to provide a production method of an extrusion molded article, a production method of a multi-passage hollow member, a production method of a tubular member, a die case for an extrusion molding die, an extrusion molding method for metal material, an extrusion molding apparatus for metal material, and related art, which can attain the aforementioned purposes.

Other objects and advantages of the present invention will be apparent from the following preferred embodiments.

Means for Solving the Problems

The present invention has the structure summarized below.

[1] An extrusion molding die for metal material, comprising:

a die case having a pressure receiving portion with an outer surface functioning as a metal material pressure receiving surface, wherein the die case is disposed so that the metal material pressure receiving surface faces rearward so as to oppose to an extrusion direction of the metal material:

a male die mounted in the die case; and a female die mounted in the die case so as to form an extrusion hole by and between the female die and the male die, wherein the pressure receiving surface is formed into a rearwardly protruded convex shape, and a plurality of metal material introducing portholes are formed in an external periphery of the pressure receiving portion at intervals in a circumferential direction around an axial center of the die case, wherein it is configured such that the metal material pressed against the metal material pressure receiving surface is introduced into the die case via the portholes and passes through the extrusion hole, and wherein B/A is adjusted to 1.8 to 6.0 and D/B is adjusted to 0.15 to 0.4, where "A" (product circumscribed circle diameter) is a diameter of a minimum circumscribed circle of a cross-section of an extrusion molded product, "B" (pressure receiving surface external diameter) is an external diameter of the metal material pressure receiving surface, "C" (between-hole-wall inlet side minimum thickness size) is a porthole inlet side minimum thickness size of a between-hole-wall formed by a wall portion between a pair of adjacent portholes, "n" is the number of the between-hole-walls, and "D" is a between-hole-wall inlet side total thickness size obtained by multiplying the number "n" of the between-hole-walls by the between-hole-wall inlet side minimum thickness size "C."

[2] The extrusion molding die for metal material as recited in the aforementioned Item 1, wherein E/C is adjusted to 0.15 to 1.0, where "E" (between-hole-wall outlet side minimum thickness size) is a porthole outlet side minimum thickness size of the between-hole-wall.

[3] The extrusion molding die for metal material as recited in the aforementioned Item 1 or 2, wherein the portholes are arranged at equal intervals around an axial center of the die case.

[4] The extrusion molding die for metal material as recited in any one of the aforementioned Items 1 to 3, wherein the pressure receiving surface of the die case is formed into a convex spherical surface constituted by a part of a spherical surface.

[5] The extrusion molding die for metal material as recited in any one of the aforementioned Items 1 to 4, wherein an inclination angle of an axial center of the porthole is set to 3 to 45° with respect to an axial center of the die case.

[6] The extrusion molding die for metal material as recited in any one of the aforementioned Items 1 to 5, wherein the extrusion hole is formed into a flat shape with a width larger than a height (thickness), and wherein the portholes are formed at positions corresponding to both thickness sides of the extrusion hole.

[7] The extrusion molding die for metal material as recited in any one of the aforementioned Items 1 to 6, wherein a flat circular extrusion hole with a width larger than a height (thickness) is formed by and between the male die and the female die, wherein a portion of the male die corresponding to the extrusion hole is formed into a comb-like configuration having a plurality of passage forming protrusions arranged in a width direction, and wherein a multi-passage hollow member having a plurality of passages arranged in a width direction is formed when metal material passes through the extrusion hole.

[8] The extrusion molding die as recited in any one of the aforementioned Items 1 to 5, wherein the male die and the female die form a circular extrusion hole, and wherein a tubular member circular in cross-section is formed when metal material passes through the extrusion hole.

[9] The extrusion molding die as recited in any one of the aforementioned Items 1 to 8, wherein the metal material pressure receiving surface is constituted by a convex spherical surface of a ⅙ sphere to a ⅘ sphere.

[10] The extrusion molding die as recited in any one of the aforementioned Items 1 to 9, wherein the metal material is aluminum or its alloy.

[11] A production method of an extrusion molded article, wherein the extrusion molded article is formed using the extrusion molding die as recited in any one of the aforementioned Items 1 to 10.

[12] A production method of a multi-passage hollow member, wherein the multi-passage hollow member is formed using the extrusion molding die as recited in the aforementioned Item 7.

[13] A production method of a tubular member circular in cross-section, wherein the tubular member is formed using the extrusion molding die as recited in the aforementioned Item 8.

[14] A die case for an extrusion molding die, comprising a pressure receiving portion with an outer surface functioning as a metal material pressure receiving surface, wherein the die case is disposed so that the metal material pressure receiving surface faces rearward so as to oppose to an extrusion direction of the metal material, and a male die and a female die are mounted in the die case, wherein the pressure receiving surface is formed into a rearwardly protruded convex shape, and a plurality of metal material introducing portholes are formed in an external periphery of the pressure receiving portion at intervals in a circumferential direction around an axial center of the die case, wherein it is configured such that the metal material pressed against the metal material pressure receiving surface is introduced into the die case via the portholes and passes through the extrusion hole, and wherein B/A is adjusted to 1.8 to 6.0 and D/B is adjusted to 0.15 to 0.4, where "A" (product circumscribed circle diameter) is a diameter of a minimum circumscribed circle of a cross-section of an extrusion molded product, "B" (pressure receiving surface external diameter) is an external diameter of the metal material pressure receiving surface, "C" (between-hole-wall inlet side minimum thickness size) is a porthole inlet side minimum thickness size of a between-hole-wall formed by a wall portion between a pair of adjacent portholes, "n" is the number of the between-hole-walls, and "D" is a between-hole-wall inlet side total thickness size obtained by multiplying the number "n" of the between-hole-walls by the between-hole-wall inlet side minimum thickness size "C."

[15] The die case for an extrusion molding die as recited in the aforementioned Item 14, wherein the metal material pressure receiving surface is constituted by a convex spherical surface of a ⅙ sphere to a ⅘ sphere.

[16] An extrusion molding method for metal material, comprising:

preparing a die case having a pressure receiving portion with an outer surface functioning as a metal material pressure receiving surface, wherein the die case is disposed so that the metal material pressure receiving surface faces rearward so as to oppose to an extrusion direction of the metal material; a male die mounted in the die case; and a female die mounted in the die case so as to form an extrusion hole by and between the female die and the male die;

forming the pressure receiving surface into a rearwardly protruded convex shape;

forming a plurality of metal material introducing portholes in an external periphery of the pressure receiving surface arranged at intervals in a circumferential direction around an axial center of the die case;

adjusting B/A to 1.8 to 6.0 and D/B to 0.15 to 0.4, where "A" (product circumscribed circle diameter) is a diameter of a minimum circumscribed circle of a cross-section of an extrusion molded product, "B" (pressure receiving surface external diameter) is an external diameter of the metal material pressure receiving surface, "C" (between-hole-wall inlet side minimum thickness size) is a porthole inlet side minimum thickness size of a between-hole-wall formed by a wall portion between a pair of adjacent portholes, "n" is the number of the between-hole-walls, and "D" is a between-hole-wall inlet side total thickness size obtained by multiplying the number "n" of the between-hole-walls by the between-hole-wall inlet side minimum thickness size "C"; and introducing the metal material pressed against the metal material pressure receiving surface into the die case via the portholes to pass through the extrusion hole.

[17] An extruder for metal material equipped with a container and an extrusion molding die set to the container, and configured to supply metal material in the container to the extrusion molding die, wherein the extrusion molding die comprises:

a die case having a pressure receiving portion with an outer surface functioning as a metal material pressure receiving surface, wherein the die case is disposed so that the metal material pressure receiving surface faces rearward so as to oppose to an extrusion direction of the metal material;

a male die mounted in the die case; and a female die mounted in the die case so as to form an extrusion hole by and between the female die and the male die, wherein the pressure receiving surface is formed into a rearwardly protruded convex shape, and a plurality of metal material introducing portholes are formed in an external periphery of the pressure receiving surface arranged at intervals in a circumferential direction around an axial center of the die case, wherein it is configured such that the metal material pressed against the metal material pressure receiving surface is introduced into the die case via the portholes and passes through the extrusion hole, and wherein B/A is adjusted to 1.8 to 6.0 and D/B is adjusted to 0.15 to 0.4, where "A" (product circumscribed circle diameter) is a diameter of a minimum circumscribed circle of a cross-section of an extrusion molded product, "B" (pressure receiving surface external diameter) is an external diameter of the metal material pressure receiving surface, "C" (between-hole-wall inlet side minimum thickness size) is a porthole inlet side minimum thickness size of a between-hole-wall formed by a wall portion between a pair of adjacent portholes, "n" is the number of the between-hole-walls, and "D" is a between-hole-wall inlet side total thickness size obtained by multiplying the number "n" of the between-hole-walls by the between-hole-wall inlet side minimum thickness size "C".

Effects of the Invention

According to the extrusion molding die of the invention [1], since the pressure receiving surface of the extrusion molding die is formed into a convex configuration, the pressing force of the metal material can be received by the pressure receiving surface in a dispersed manner when the metal material is pressed against the pressure receiving surface, which in turn can reduce the pressing force in the normal direction at each portion of the pressure receiving surface. As a result, the strength against the pressing force of the metal material can be improved, resulting in further improved durability. In other words, in cases where the metal material is pressed against the pressure receiving surface of a convex configuration, since a compressing force toward the central axis of the pressure receiving portion is applied to each portion of the pressure receiving surface, the shearing force to be generated in the die case at the time of extrusion will be reduced. As a result, the shearing forces generated at the positions of the die case exposed to the hollow portion of the die case, which are portions where the largest shearing force will be generated, can be reduced, which in turn can improve the strength of the extrusion molding die against the pressing force of the metal material.

Furthermore, in the present invention, the material introducing portholes are formed in the pressure receiving portion of the die case covering the male die and the female die, i.e., the front end (downstream side) wall portion of the pressure receiving portion is integrally formed in the peripheral direction in a continuous manner. Therefore, the existence of the continuous peripheral wall portion further improves the strength of the die case, which in turn can further improve the strength of the entire extrusion molding die. Thus, in the die according to the present invention, there exists no portion weak in strength, such as a conventional bridge portion, and it is not required to increase the size such as a thickness to improve the strength beyond necessity. This enables reduction in size and weight, and also enables cost reduction.

Furthermore, in the present invention, since the size ratio in prescribed portions is adjusted to an optimal value based on, e.g., experimental data, extrusion molding can be performed in a stable manner, and a further extended die life can be attained.

According to the extrusion molding die of the invention [2], extrusion molding can be performed in a more stable manner.

According to the extrusion molding die of the invention [3], the metal material can be introduced toward the extrusion hole evenly from the peripheral direction, which enables extrusion molding in a more stable manner.

According to the extrusion molding die for metal material of the invention [4], the durability can be improved more assuredly, and extrusion molding can be performed more smoothly. In other words, in cases where the metal material is pressed against the pressure receiving surface of a convex spherical surface constituted by a part of a spherical surface, since a compressing force toward the central axis of the pressure receiving portion is applied to each portion of the pressure receiving surface, the shearing force to be generated in the die case at the time of extrusion molding can be reduced more assuredly. As a result, the shearing forces generated at the positions of the die case exposed to the hollow portion of the die case, which are portions where the largest shearing force will be generated, can be reduced assuredly, which in turn can more assuredly improve the strength of the extrusion molding die against the pressing force of the metal material.

According to the extrusion molding die for metal material of the invention [5], it is possible to more smoothly introduce the metal material from the portholes into the extrusion hole.

According to the extrusion molding die for metal material of the invention [6], a flat extrusion molded article can be formed with high dimensional accuracy.

According to the extrusion molding die for metal material of the invention [7], a multi-passage hollow member with a plurality of passages arranged in parallel in the width direction can be formed assuredly.

According to the extrusion molding die for metal material of the invention [8], a tubular member circular in cross-section can be formed assuredly.

According to the extrusion molding die for metal material of the invention [9], since the metal material pressure receiving surface is constituted by a specific convex spherical surface, the pressing force of the metal material against the pressure receiving surface can be dispersed more assuredly in a balanced manner, which can improve the strength against the metal material more assuredly. In other words, in cases where the metal material is pressed against the pressure receiving surface of a convex spherical surface constituted by a part of a spherical surface, since compressing force toward the central axis of the pressure receiving portion is applied to each portion of the pressure receiving surface, the shearing force to be generated in the die case at the time of extrusion molding can be reduced more assuredly. As a result, the shearing forces generated at the positions of the die case exposed to the hollow portion of the die case, which are portions where the largest shearing force will be generated, can be reduced assuredly, which in turn can more assuredly improve the strength of the extrusion molding die against the pressing force of the metal material.

According to the extrusion molding die for metal material of the invention [10], an aluminum or aluminum alloy extrusion molded article can be produced.

According to the invention [11], an extrusion molded article production method having the same effects as mentioned above can be provided.

According to the invention [12], a multi-passage hollow member production method having the same effects as mentioned above can be provided.

According to the invention [13], a tubular member production method having the same effects as mentioned above can be provided.

According to the invention [14], a die case for an extrusion molding die having the same effects as mentioned above can be provided.

According to the die case for the extrusion molding die of the invention [15], the pressing force of the metal material against the pressure receiving surface can be dispersed more assuredly in a balanced manner, which can improve the strength against the metal material more assuredly.

According to the invention [16], a metal material extrusion molding method for metal material having the same effects as mentioned above can be provided.

According to the invention [17], an extruder for metal material having the same effects as mentioned above can be provided.

BRIEF DESCRIPTION OF THE REFERENCE NUMERALS

Figure 1:
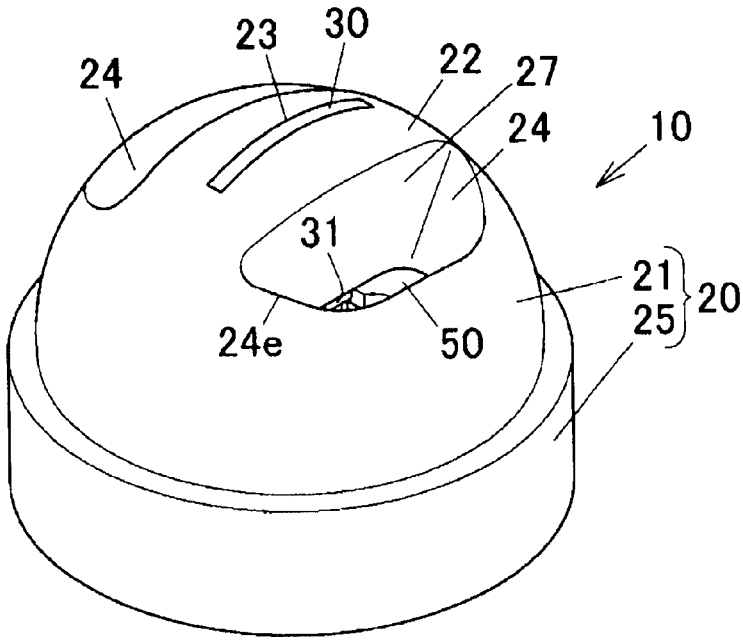
FIG. 1 is a perspective view showing an extrusion molding die according to a first embodiment of the present invention.

6 . . . Container
10 . . . extrusion molding die
11 . . . extrusion hole
20 . . . die case
21 . . . pressure receiving portion
22 . . . billet pressure receiving surface (metal material pressure receiving surface)
24 . . . porthole
24*e* . . . inlet
27 . . . between-hole-wall
30 . . . male die
33 . . . passage forming protruded portion
40 . . . female die
60 . . . hollow member
63 . . . passage
A . . . product circumscribed circle diameter
B . . . pressure receiving surface external diameter
C . . . between-hole-wall inlet side minimum wall thickness
E . . . between-hole-wall outlet side minimum wall thickness
X1 . . . axial center of the die case (pressure receiving portion)
X2 . . . axial center of the porthole
θ . . . inclination angle

BEST MODE FOR CARRYING OUT THE INVENTION

First Embodiment

Figure 12:
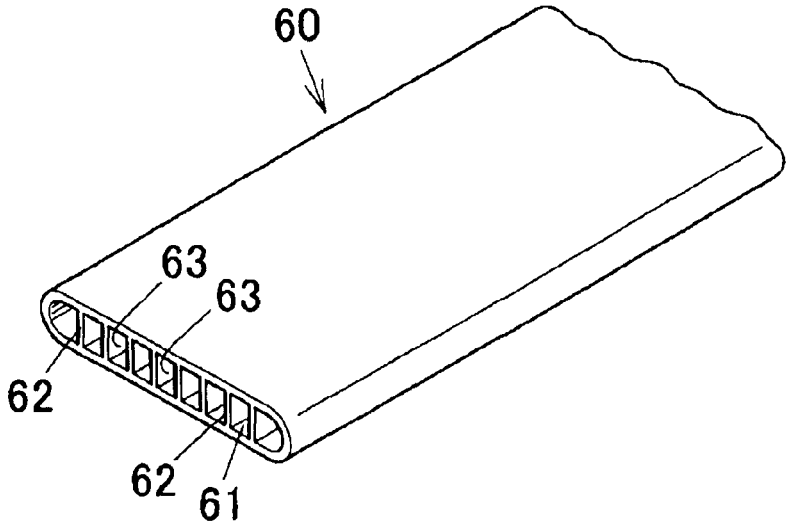
FIG. 12 is a perspective view showing a multi-passage hollow member extruded by the extruder.
Figure 13:
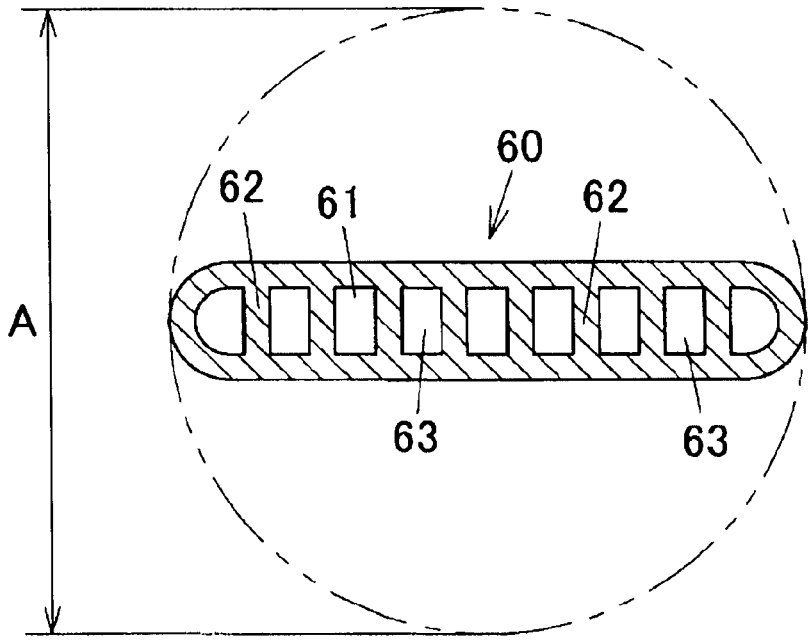
FIG. 13 is a front cross-sectional view showing the multi-passage hollow member extruded by the extruder.
Figure 14:
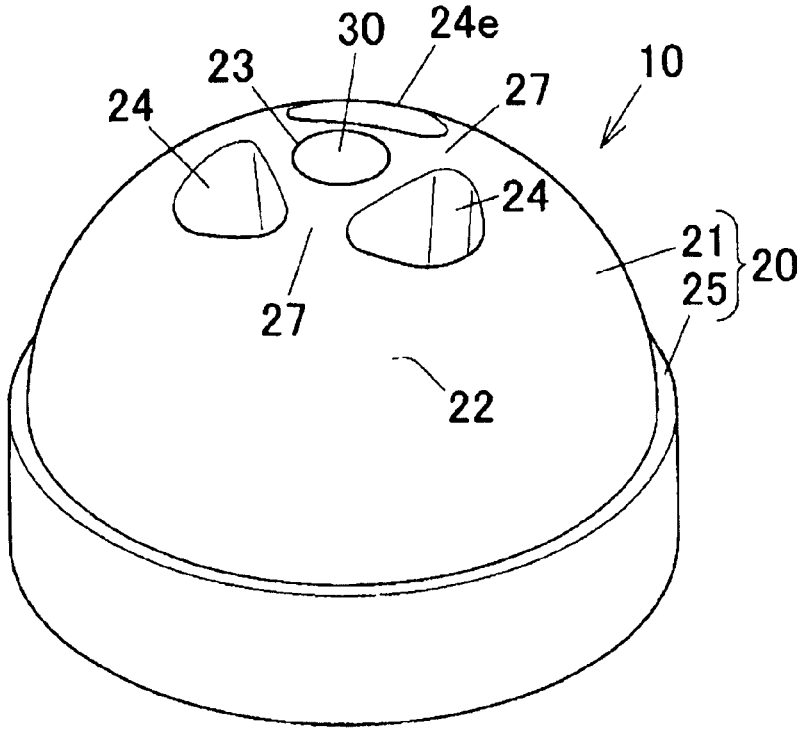
FIG. 14 is a perspective view showing an extrusion forming die according to a second embodiment of the present invention.
Figure 15:
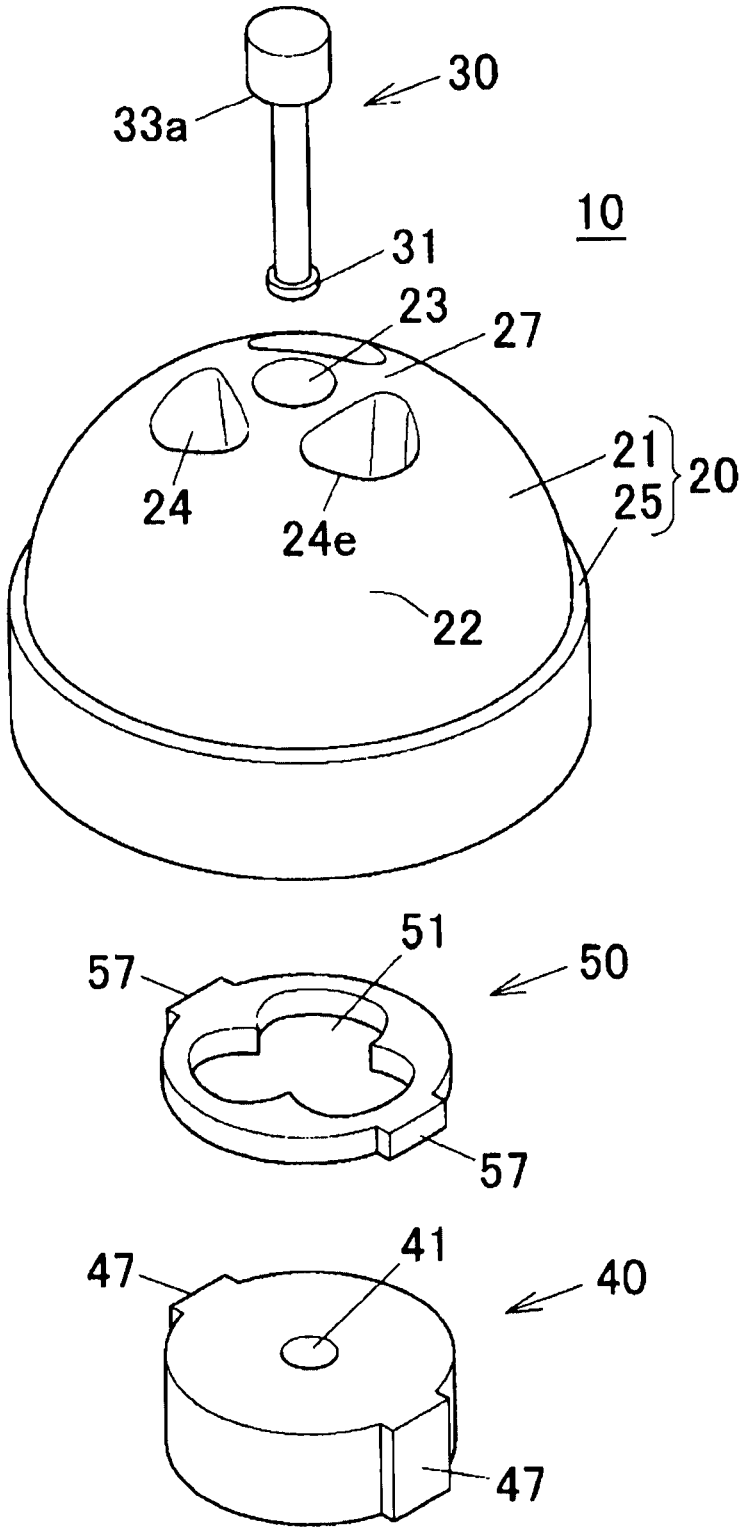
FIG. 15 is an exploded perspective view of the extrusion molding die.

The extrusion molding die 10 for metal material according to a first embodiment of this invention is configured to extrude a multi-passage hollow member 60 shown in FIGS. 12 and 13.

The hollow member 60 is a metal member. In this embodiment, concretely, the hollow member constitutes a heat exchanging tube made of aluminum or aluminum alloy.

This hollow member 60 is a member for use in a heat exchanger, such as, e.g., a condenser for car air-conditioners, and has a flattened configuration having a width larger than a thickness. The hollow portion 61 of this hollow member 60 is divided into a plurality of heat exchanging passages 63 by a plurality of partitioning walls 62 extended in the tube length direction and arranged in parallel with each other. Thus, these passages 63 are extended in the tube length direction and arranged in parallel with each other.

In this embodiment, a direction with which the tube length direction perpendicularly intersects and along which the passages 63 are arranged will be referred to as a "width direction" or a "lateral direction," and a direction with which the tube length direction perpendicularly intersects and with which the width direction perpendicularly intersects will be referred to as a "height direction (thickness direction)" or a "vertical direction." Furthermore, in this embodiment, the following explanation will be made by defining the "upstream side" of the extrusion direction as a "rear side" and the "downstream side" thereof as a "front side."

FIGS. 1 to 6 show an extrusion molding die 10 according to a first embodiment of the present invention. As shown in these figures, the extrusion molding die 10 is equipped with a die case 20, a male die 30, a female die 40, and a flow control plate 50.

The die case 20 has a hollow structure, and is comprised of a dome-shaped pressure receiving portion 21 to be arranged at the upstream side (rear side) with respect to the extrusion direction of a metal billet as metal material and a base portion 25 to be arranged at the downstream side (front side).

In the pressure receiving portion 21, the surface thereof (rear surface) facing to a direction opposite to the extrusion direction of the metal billet constitutes a billet pressure receiving surface 22 as a metal material pressure receiving surface. This billet pressure receiving surface 22 is formed into a convex configuration protruded in a direction (i.e., in a rear direction) opposite to the extrusion direction, more specifically, a convex hemispherical surface configuration. Thus, the pressure receiving portion 21 is formed into a rearwardly protruded configuration.

Figure 6:
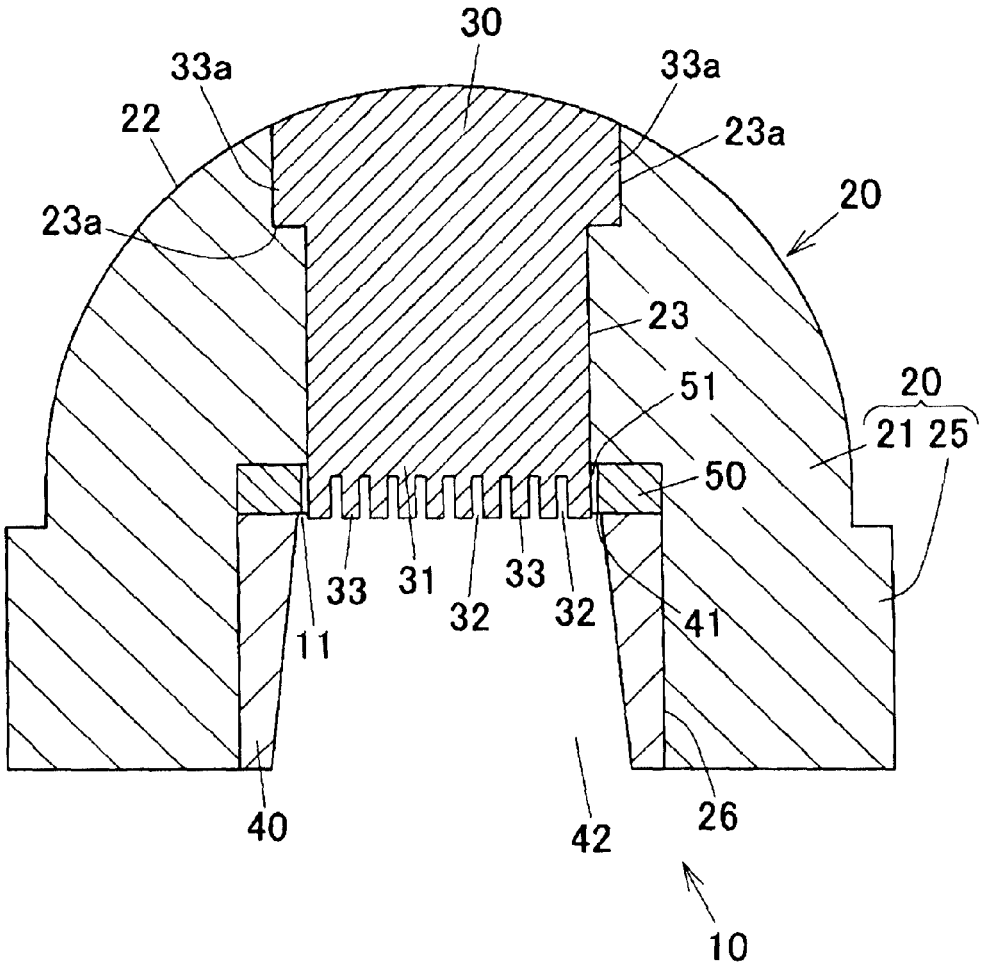
FIG. 6 is another side cross-sectional view of the extrusion molding die.

In the peripheral wall center of the pressure receiving portion 21, a male die holding slit 23 communicated with the internal hollow portion (i.e., welding chamber 12) is formed along the central axis X1. This male die holding slit 23 is formed into a flat rectangular cross-sectional configuration corresponding to the cross-sectional configuration of the male die 30. Furthermore, as shown in FIG. 6, at both side portions of the rear end side of the male die holding slit 23, engaging stepped portions 23*a* and 23*a* as engaging means for engaging the male die 30, which will be mentioned later, are formed.

At both sides of the peripheral wall of the pressure receiving portion 21 across the central axis X1, a pair of portholes 24 and 24 are formed. The inlet 24*e* of each porthole 24 is formed into a generally trapezoidal shape as seen from the upstream side of the axial direction (in a plan view).

The pair of portholes 24 and 24 are arranged such that the outlet portions (i.e., front end portions) face an extrusion hole which will be mentioned later. In this embodiment, a between-hole-wall 27 is formed by the portion (wall portion) located between the pair of portholes 24 and 24 formed in the die case 20.

Each porthole 24 is arranged such that the central axis X2 of the porthole 24 approaches the central axis X1 of the pressure receiving portion 21 as it advances toward the downstream side and intersects with the central axis X1 of the pressure receiving portion 21 in an inclined state. The detail structure, such as, e.g., the inclination angle θ of the central axis X2 of this porthole 24, and the dimensional ratio of prescribed portions, will be detailed later.

In this embodiment, it is constituted such that the central axis of the die case 20 coincides with the central axis of the pressure receiving portion 21.

The base portion 25 is integrally formed with the pressure receiving portion 21 and formed into a circular configuration centering on the axial center. The base portion 25 has a diameter larger than that of the pressure receiving portion 21.

In the present invention, the base portion 25 and the pressure receiving portion 21 are not always required to be formed integrally, and can be formed separately. Whether both the portions 21 and 25 are to be formed integrally or separately can be arbitrarily decided in consideration of various factors, such as, e.g., maintenance efficiency.

At the inner side of the base portion 25, a female die holding hole 26 having a columnar shape (cylindrical shape) corresponding to the cross-sectional shape of the female die 40 and communicated with the inner welding chamber 12 is formed. The central axis of this female die holding hole 26 is configured so as to coincide with the central axis X1 of the die case 20.

At the rear end side in the inner periphery of the female die holding hole 26, as shown in, e.g., FIGS. 4 to 7, an engaging stepped portion 26*a* for engaging the female die 40, which will be explained later, via a flow control plate 50 is formed.

Figure 7:
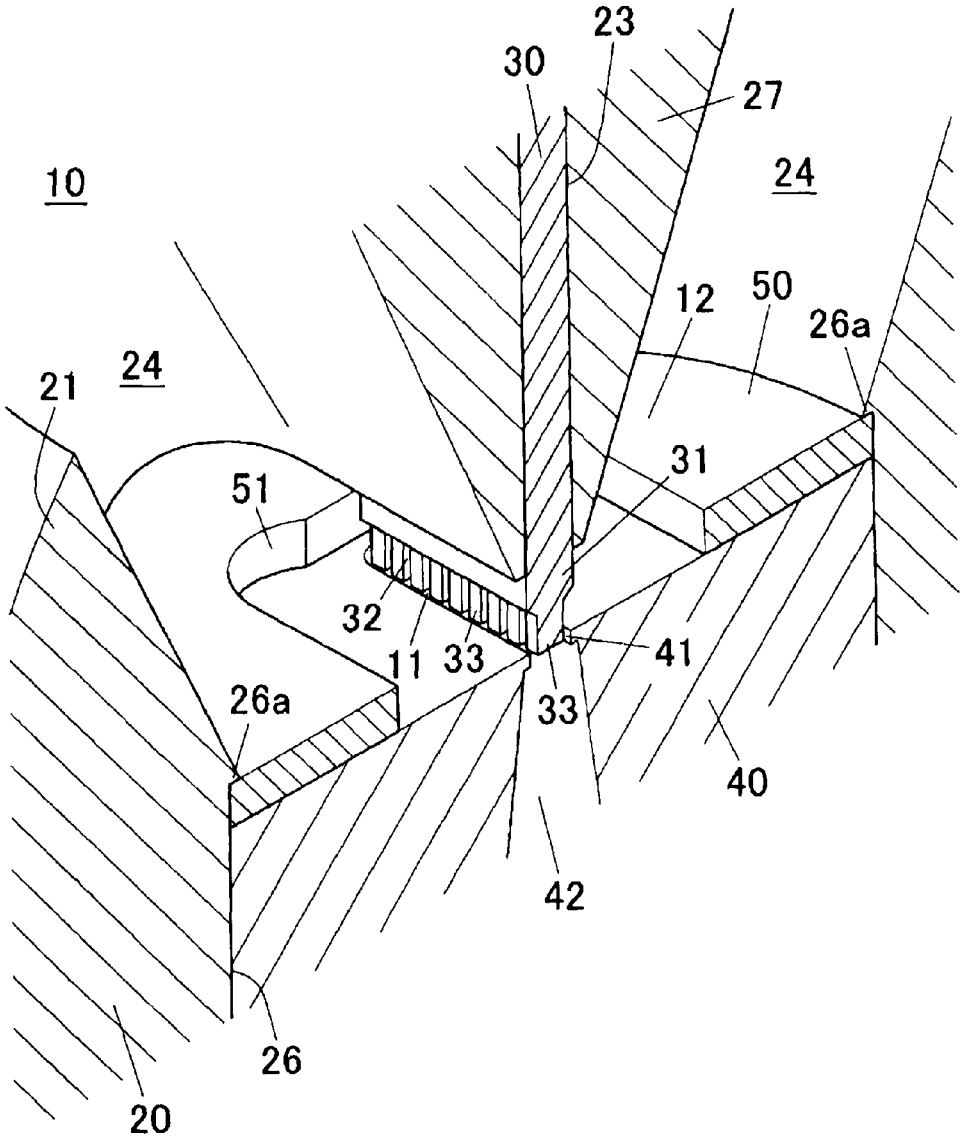
FIG. 7 is an enlarged perspective view showing an inner cross-section of the extrusion molding die.

The male die 30 is configured such that the front half principal portion thereof constitutes a mandrel 31. As shown in FIGS. 6 and 7, the front end portion of the mandrel 31 is configured to form the hollow portion 61 of the hollow member 60 and has a plurality of passage forming protruded portions 33 corresponding to the passages 63 of the hollow member 60 respectively. These plural passage forming protruded portions 33 are arranged along the width direction of the mandrel 31 at predetermined intervals. Each gap formed between adjacent passage forming protruded portions 33 constitutes a partition forming groove 32 for forming the partition 62 of the hollow member 60.

Figure 2:
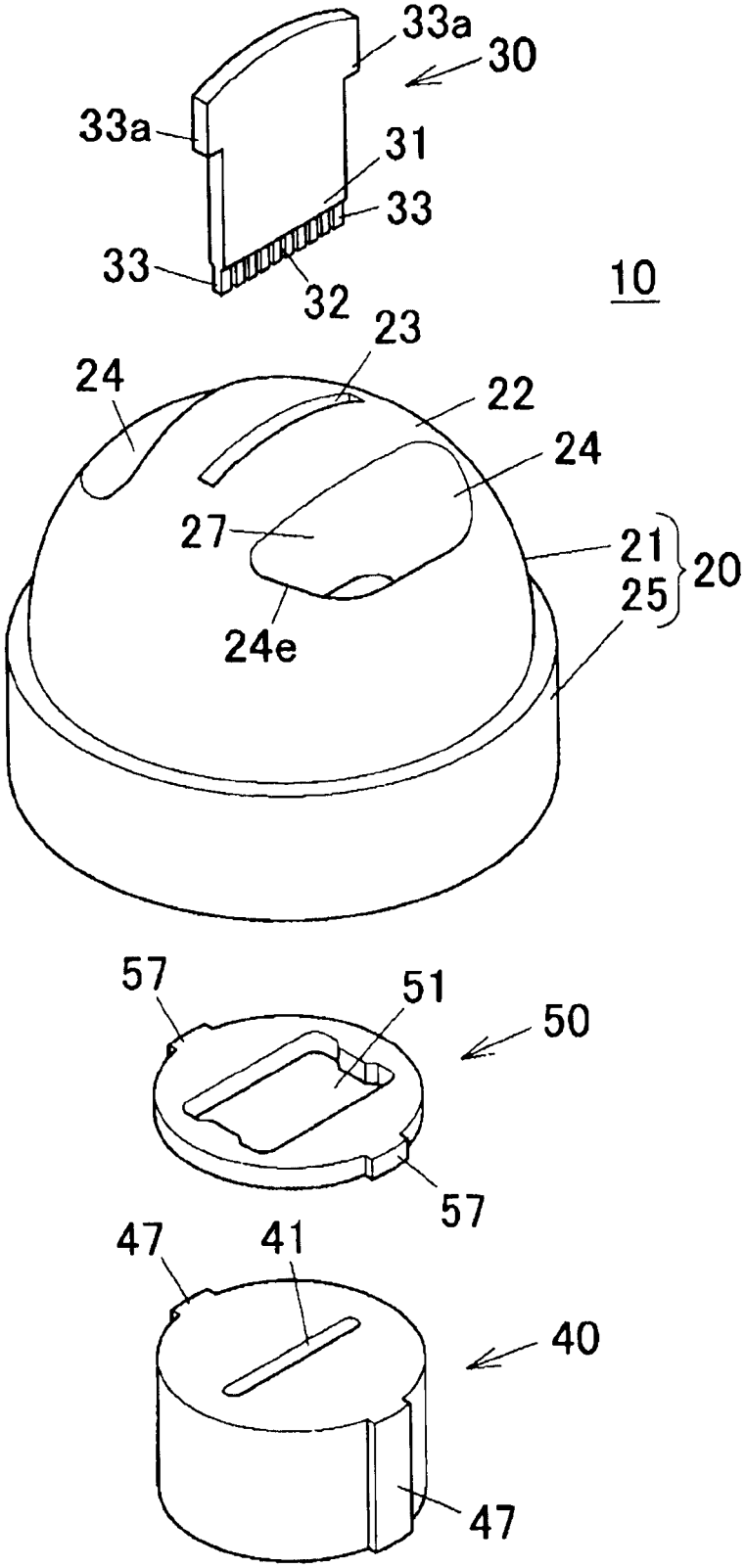
FIG. 2 is an exploded perspective view of the extrusion molding die.

As shown in FIGS. 2 and 6, at both the widthwise side edges of the rear end portion of the male die 30, engaging protrusions 33*a* and 33*a* corresponding to the aforementioned engaging stepped portions 23*a* and 23*a* of the male die holding slit 23 formed in the die case 20 are integrally provided in a laterally protruded manner.

This male die 30 is inserted into the male die holding slit 23 of the aforementioned die case 20 from the side of the billet pressure receiving surface 22 and fixed therein. At this time, the engaging protrusions 33*a* and 33*a* of the male die 30 are engaged with the engaging stepped portions 23*a* and 23*a* formed in the male die holding slit 23 to be positioned. Thus, the mandrel 31 of the male die 30 is held in a state in which the mandrel 31 of the male die 30 forwardly protrudes from the male die holding slit 23 in the die case 20 by a predetermined amount.

The basal end face (i.e., rear end face) of the male die 30 is formed so as to constitute a part of the convex hemispherical surface corresponding to the billet pressure receiving surface 22 of the die case 20, so that the basal end face (i.e., rear end face) of the male die 30 and the billet pressure receiving surface 22 form a prescribed smooth convex hemispherical surface. In the present invention, however, it is not always required to form the basal end face of the male die 30 as a part of the hemispherical surface, and the configuration of the basal end face is not specifically limited. For example, in cases where the surface area of the basal end face of the male die 30 is ⅓ or less of the surface area of the billet pressure receiving surface 22, it can be constituted such that the basal end face of the male die 30 is formed by a part of a cylindrical external peripheral surface in which the basal end face of the male die 30 is formed to have a circular arc shape in the longitudinal direction (width direction) corresponding to the billet pressure receiving surface 22 and a linear shape in the traverse direction (thickness direction).

The female die 40 has a cylindrical shape. As shown in FIG. 2, at its both sides of the peripheral surface, key protrusions 47 and 47 extended in parallel with the central axis are formed.

The female die 40 is provided with a die hole (bearing hole 41) opened to the rear end face side thereof and formed corresponding to the mandrel 31 of the male die 30, and a relief hole 42 communicated with the die hole 41 and opened to the front end face side thereof.

The die hole 41 is provided with an inwardly protruded portion along the inner peripheral edge portion so that an outer peripheral portion of the hollow member 60 can be defined. The relief hole 42 is formed into a tapered shape which gradually increases in thickness (height) toward the front end side (downstream side) and opened at the downstream side.

As shown in FIG. 2, the flow control plate 50 is formed to have a round external peripheral shape corresponding to the cross-sectional shape of the female die holding hole 26 of the die case 20. Corresponding to the mandrel 31 of the male die 30 and the die hole 41 of the female die 40, a central through-hole 51 is formed at the center of the flow control plate 50.

The flow control plate 50 has, at its both sides of the external peripheral edge portion, key protrusions 57 and 57 corresponding to the key protrusions 47 and 47 of the female die 40 are formed.

Figure 4:
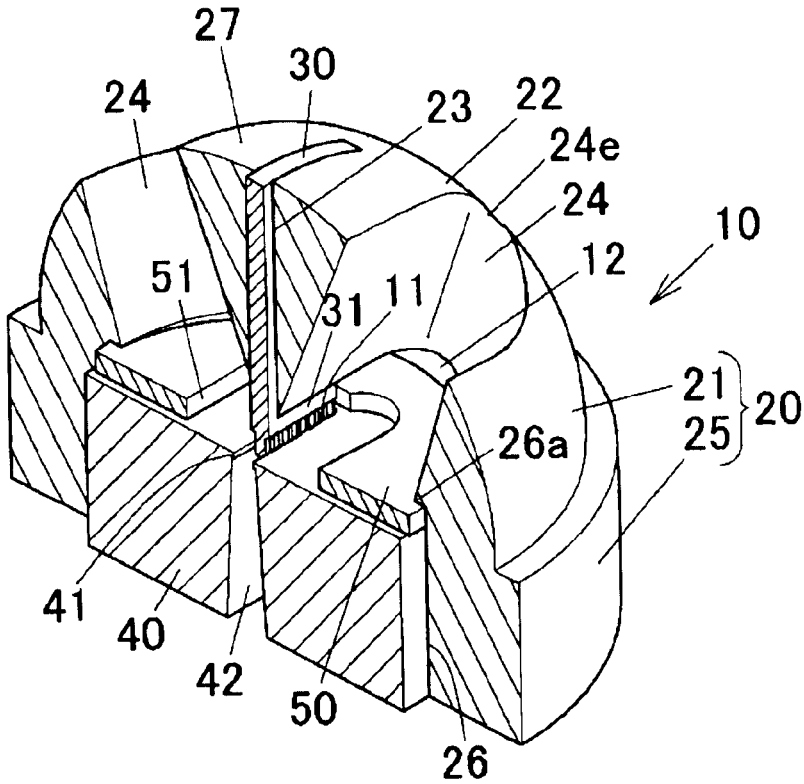
FIG. 4 is a cut-out perspective view of the extrusion molding die.
Figure 5:
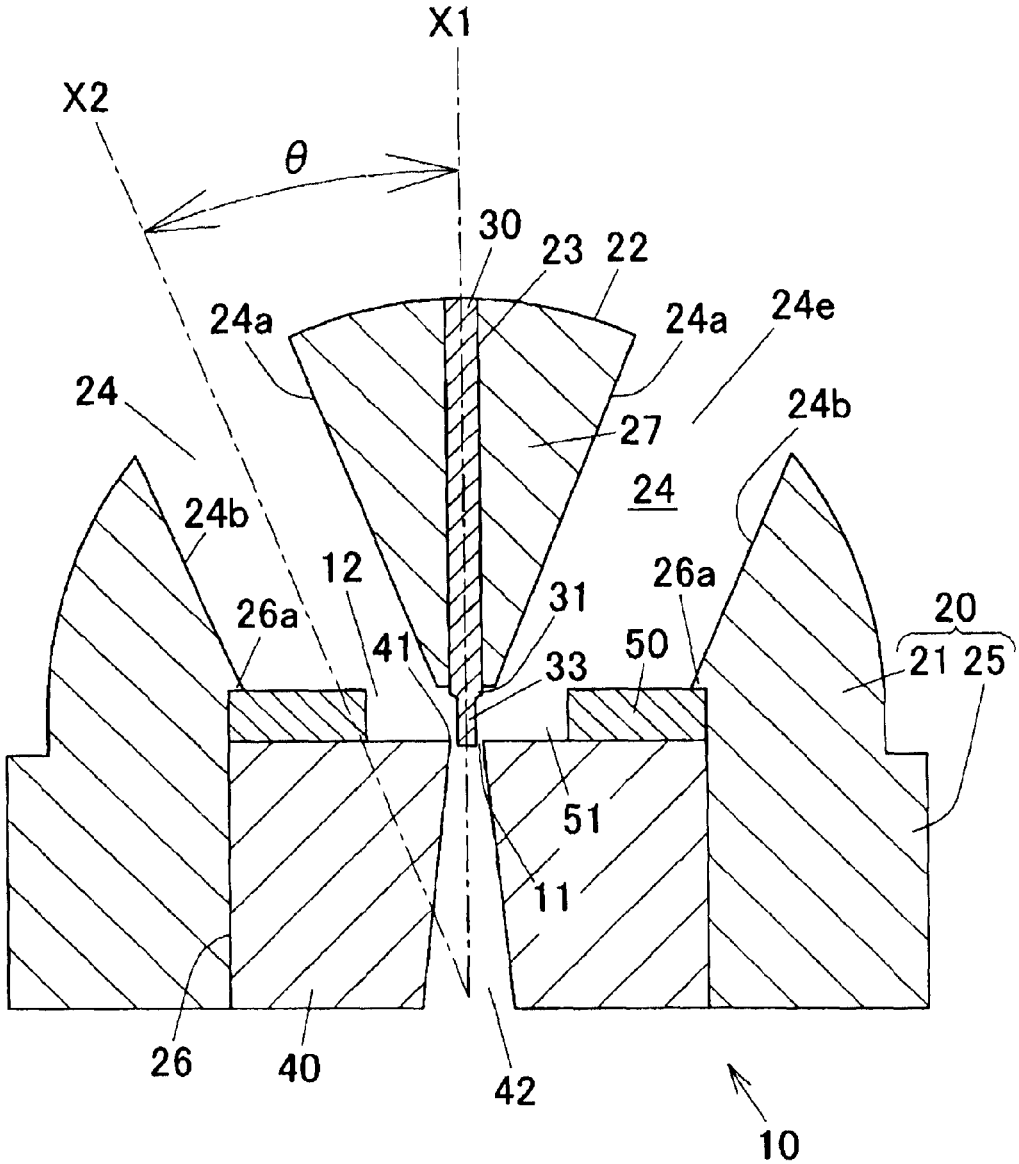
FIG. 5 is one side cross-sectional view of the extrusion molding die.

As shown in FIGS. 4 to 6, the female die 40 is mounted and secured in the female die holding hole 26 of the die case 20 via the flow control plate 50. In this mounted state, the external periphery of one end face (rear end face) of the female die 40 is engaged with the engaging stepped portion 26*a* of the female die holding hole 26 via the external peripheral edge portion of the flow control plate 50, so that the female die 40 and the flow control plate 50 are positioned in the axial direction. At the same time, the key protrusions 47 and 47 of the female die 40 and the key protrusions 57 and 57 of the flow control plate 50 are engaged with the keyways (not illustrated) formed in the inner peripheral surface of the female die holding hole 26 to be positioned in the circumference direction about the central axis.

Thus, the mandrel 31 of the male die 30 and the die hole 41 of the female die 40 are positioned in the central through-hole 51 of the flow control plate 50. At this time, the mandrel 31 of the male die 30 is positioned within the die hole 41 of the female die 40, which forms a flat circular extrusion hole 11 by and between the mandrel 31 and the die hole 41. This extrusion hole 11 is formed to have a cross-sectional configuration corresponding to the cross-sectional configuration of the hollow member 60 to be formed in which a plurality of partition forming grooves 32 of the mandrel 31 are arranged in parallel in the widthwise direction.

In this embodiment, as shown in FIG. 5, the central axes X2 of the portholes 24 and 24 are set to be inclined with respect to the central axis X1 of the die case 20 respectively as it advances toward the downstream side. In this embodiment, it is preferable that the inclination angle θ of the central axis X2 of the porthole 24 with respect to the central axis X1 of the die case 20 is set to 3 to 45°, more preferably 10 to 35°, still more preferably 15 to 30°. When the inclination angle θ is set so as to fall within the above specified ranges, the metal material flows through the portholes 24 and 24 and the welding chamber 12 in a stable manner, and then smoothly passes through the entire periphery of the extrusion hole 11 in a balanced manner. As a result, a high quality extrusion molded article (extrusion molded product) excellent in dimensional accuracy can be formed. In other words, if the inclination angle θ is too small, the metal material passed through the portholes 24 and 24 and the welding chamber 12 cannot be smoothly introduced into the extrusion hole 11, which may sometimes make it difficult to stably obtain a high quality extrusion molded article. To the contrary, if the inclination angle θ is too large, the material flowing direction of the porthole 24 with respect to the material extrusion direction inclines largely, which increases the extrusion resistance of the metal material, and therefore it is not preferable.

Figure 3:
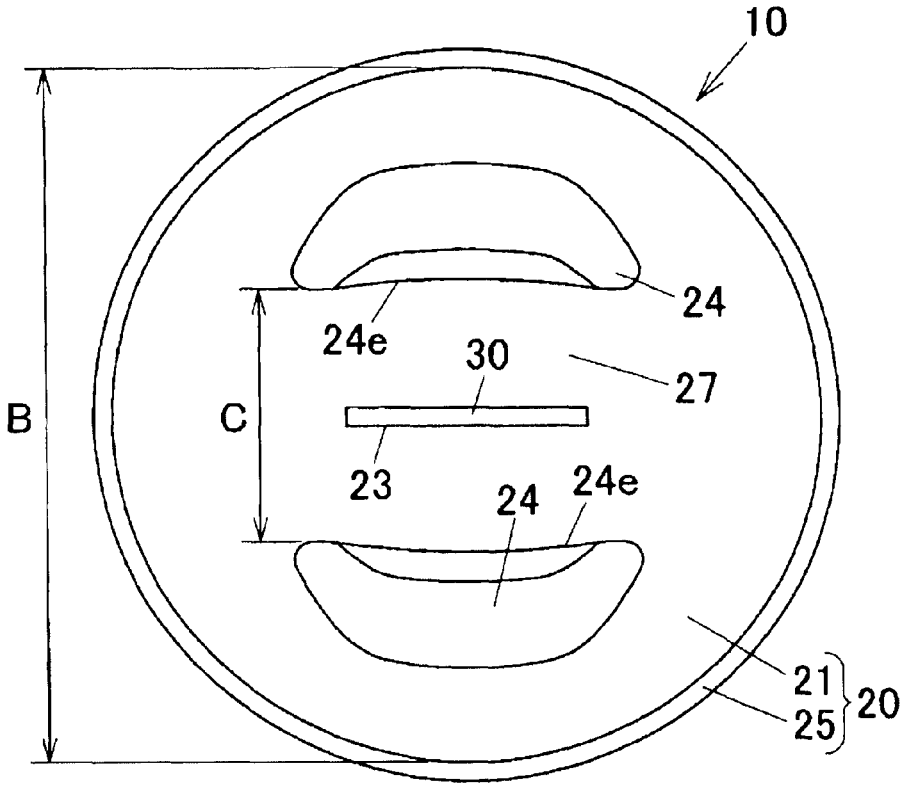
FIG. 3 is a rear (front) view of the extrusion molding die.

In this embodiment, assuming that the diameter of the minimum circumscribed circle of the cross-section of the hollow member 60 as an extrusion molded product (extrusion molded article) as shown by the imaginary line in FIG. 13 is defined as "A" (product circumscribed circle diameter) and that the external diameter of the metal material pressure receiving surface 22 in a state in which the pressure receiving surface 22 is seen from the upstream side in the axial center direction as shown in FIG. 3 (in a top view state) is defined as "B" (pressure receiving surface external diameter), it is required to adjust B/A to 1.8 to 6.0 ($1.8 \leqq B/A \leqq 6.0$). Preferably, B/A is adjusted to 2.0 to 5.0, more preferably 2.0 to 4.5. When B/A is adjusted so as to fall within the aforementioned range, sufficient strength can be given to the die case 20 while restraining the production cost. In other words, if B/A is too small, the die case 20 deteriorates in strength, which may result in shortened die life. On the other hand, if B/A is excessively large, the production cost increases, which may make it difficult to attain the corresponding effects.

Please note that the "product circumscribed circle" is equal to the "circumscribed circle" defined on page 88 of "Aluminum handbook ($5^{th}$ edition)" issued by Shadan Hoj in Light Metal Association, and the "A" corresponds to the diameter of the "circumscribed circle."

Furthermore, in the present invention, assuming that the porthole inlet side minimum thickness size of the between-hole-wall 27 formed by the wall portion between the pair of portholes 24 and 24 as shown in FIG. 3 is defined as "C" (between-hole-wall inlet side minimum thickness size), and the between-hole-wall inlet side total thickness size obtained by multiplying the number "n" of the between-hole-walls 27 by the between-hole-wall inlet side minimum thickness size "C" is defined as "D," it is required to adjust D/B to 0.15 to 0.4 ($0.15 \leqq D/B \leqq 0.4$). Preferably, D/B is adjusted to 0.15 to 0.35, more preferably 0.15 to 0.3. When D/B is adjusted so as to fall within the aforementioned specific range, extrusion can be performed in a stable manner. In other words, if D/B is too small, sufficient pressing force cannot be applied in the central direction of the pressure receiving portion 21 at the time of the extrusion molding (extrusion forming), causing larger deformation in the extrusion direction. As a result, this may cause deteriorated strength of the die case 20. On the other hand, if D/B is excessively large, the extrusion load becomes excessively higher, which may make it difficult to perform the extrusion. In the first embodiment, the number of between-hole-wall 27 is "1."

Figure 8:
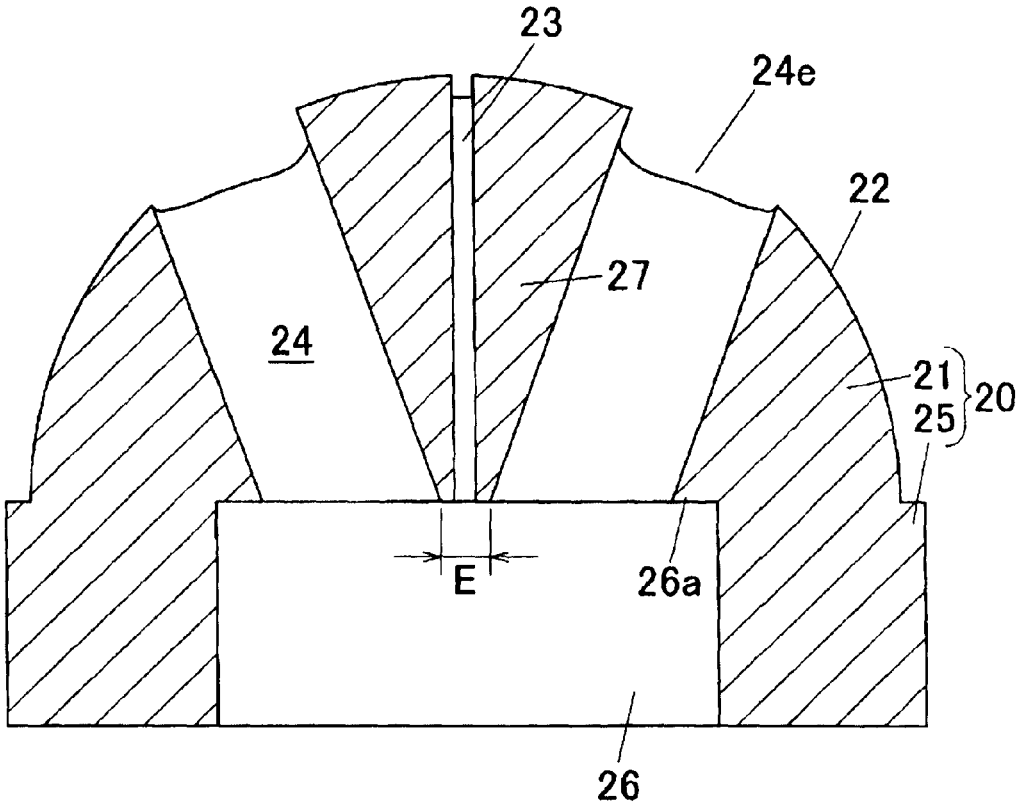
FIG. 8 is a cross-sectional view of a die case of the extrusion molding die.

Furthermore, in the embodiment, assuming that the porthole outlet side minimum thickness size of the between-hole-wall 27 is defined as "E" (between-hole-wall outlet side minimum thickness size) as shown in FIG. 8, it is preferable to adjust E/C to 0.15 to 1.0 ($0.15 \leqq E/C \leqq 1.0$). Preferably, E/C is adjusted to 0.15 to 0.8, more preferably 0.15 to 0.7. When E/C is adjusted so as to fall within the aforementioned specific range, extrusion can be performed in a stable manner while securing sufficient strength of the die case 20. In other words, if E/C is too small, the between-hole-wall 27 cannot withstand against the extrusion load, which may cause deteriorated strength of the die case 20. On the other hand, if E/C is excessively large, the extrusion load increases excessively, resulting in unsmooth introduction of the metal material into the die, which may make it difficult to perform the extrusion in a stable state.

Furthermore, in this embodiment, it is preferably constructed such that the billet pressure receiving surface 22 of the die case 20 has a convex spherical surface of ⅙ sphere to a ⅚ sphere. When the billet pressure receiving surface 22 is formed into the aforementioned specific convex spherical configuration, the pressing force of the metal billet can be assuredly received by the billet pressure receiving surface 22 in a well-balanced dispersed manner, resulting in sufficient strength, which in turn can extend the die life more assuredly. That is, when a billet is pressed against the pressure receiving surface 22 constituted by a specific convex spherical configuration, compressing forces toward the center of the pressure receiving portion 21 are more assuredly applied to each portion of the pressure receiving surface 22, and therefore the shearing force to be generated in the die case 20 at the time of the extrusion molding is reduced more assuredly. As a result, the shearing forces generated at the positions of the die case 20 exposed to the hollow portion of the die case 20, which are portions where the largest shearing force will be generated in the die case 20, can be reduced assuredly. Thus, the strength of the die 10 against the pressing force of the billet can be improved more assuredly. In addition to the above, it also makes it possible to simplify the die configuration, reduce the size and weight, and also attain the cost reduction. In other words, if the billet pressure receiving surface 22 is formed by a configuration constituted by a convex spherical surface of a sphere smaller than a ⅙ sphere, such as, e.g., a convex spherical surface constituted by a ⅛ sphere, sufficient strength against billet pressing force cannot be obtained, which may cause deteriorated die life due to generation of cracks. To the contrary, if the billet pressure receiving surface 22 is formed into a configuration constituted by a convex spherical surface of a sphere exceeding a ⅘ sphere, such as, e.g., a convex spherical surface configuration of a ⅚ sphere, the cost may be increased due to the complicated configuration.

In this embodiment, the sphere with a ratio, such as, e.g., a ⅛ sphere, a ⅙ sphere, or a ⅘ sphere, is defined by a partial sphere obtained by cutting a perfect sphere with a plane perpendicular to the central axis of the perfect sphere. That is, in this embodiment, an "m/M sphere ("m" and "M" are natural numbers, and m<M)" is defined by a partial sphere obtained by cutting a perfect sphere with a plane perpendicular to the central axis of the perfect sphere at a position where a distance from a surface of the perfect sphere to an inner position of the perfect sphere on the central axis (diameter) is m/M, where the length of the central axis (diameter) of the perfect sphere is "1."

As shown in FIG. 5, in this embodiment, the inner side surface 24*a* and the outer side surface 24*b* among the inner periphery of the porthole 24 are arranged in parallel or generally in parallel with each other and also in parallel or generally in parallel to the central axis A2 of the porthole 24. Furthermore, the inner side surface 24*a* and the outer side surface 24*b* of the porthole inner periphery are each constituted as an inclined surface (tapered surface) inclined to the central axis X1 of the die case 20.

The extrusion molding die 10 structured as mentioned above is set to an extruder as shown in FIGS. 9 to 11. That is, the extrusion molding die 10 of this embodiment is set to a container 6 with the die attached to the die mounting hole 5*a* formed in the center of the plate 5. The extrusion molding die 10 is fixed in a direction perpendicular to the extrusion direction by the plate 5 and also fixed in the extrusion direction by the backer (not illustrated).

Figure 9:
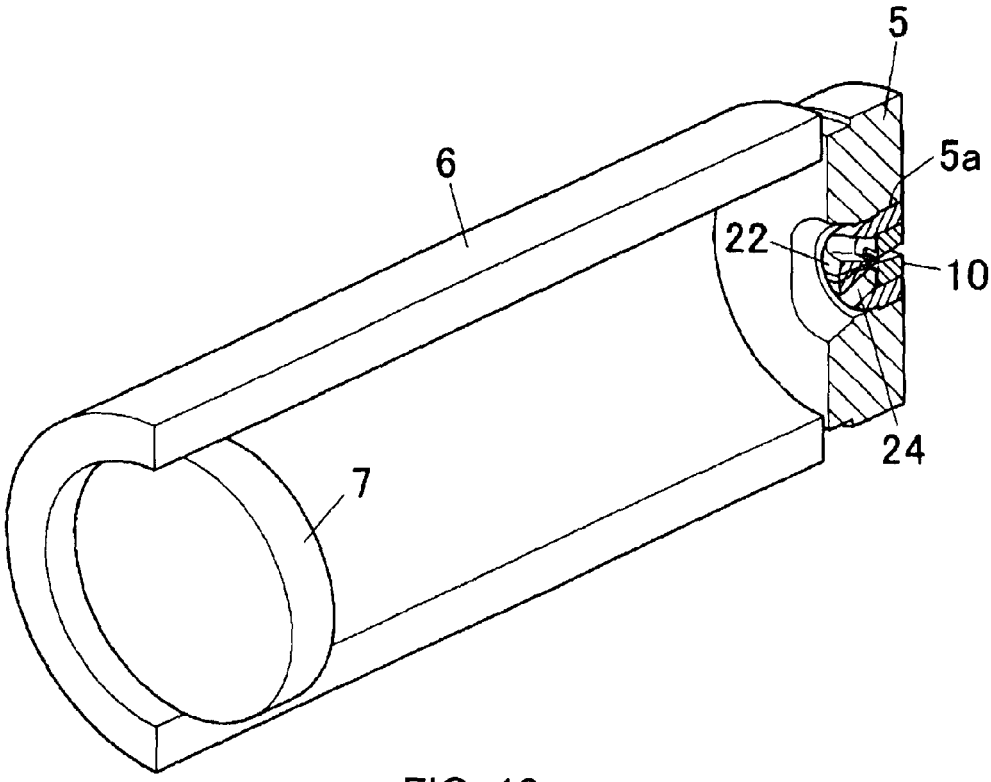
FIG. 9 a cut-out perspective view of a principle portion of an extruder to which the extrusion molding die is applied.

A metal billet (metal material), such as, e.g., an aluminum or aluminum alloy billet, inserted in the container 6 is pressed in the right direction in FIG. 9 (i.e., in the extrusion direction) via a dummy block 7. Thereby, the metal billet is pressed against the billet pressure receiving surface 22 of the die case 20 of the extrusion molding die 10 to be plastically deformed. As a result, the metal material passes through the pair of portholes 24 and 24 while being plastically deformed and then reaches the welding chamber 12 of the die case 20. Then, the metal material is forwardly extruded through the extrusion hole 11 into a cross-sectional configuration corresponding to the opening configuration of the extrusion hole 11. Thus, a metal extrusion molded product (multi-passage hollow member 60) is manufactured.

According to the extrusion molding die 10 of this embodiment, since the billet pressure receiving surface 22 is formed into a convex spherical configuration, when the metal billet is pressed against the billet pressure receiving surface 22, the pressing force can be received by the pressure receiving surface 22 in a dispersed manner. Therefore, the pressing force to be applied to each portion of the billet pressure receiving surface 22 in the direction of a normal line can be reduced, thereby increasing the strength against the pressing force of the metal material. As a result, sufficient durability can be attained.

Furthermore, in this embodiment, the ratio B/A of the pressure receiving surface external diameter B to the product circumscribed circle diameter A, the ratio D/B of the between-hole-wall inlet side total thickness size D to the receiving pressure surface diameter B, and the ratio E/C of the between-hole-wall outlet side minimum thickness size E to the between-hole-wall inlet side minimum thickness size C are adjusted so as to fall within the aforementioned optimum ranges. Therefore, sufficient strength of the die case 20 can be secured, and stable extrusion molding can be performed smoothly while attaining the long die life.

In this embodiment, the portholes 24 for introducing materials are formed in the pressure receiving portion 21 of the die case 20 covering the male die 30 and the female die 40. In other words, the front end wall portion of the pressure receiving portion 21 and the wall portion of the base portion 25 are formed integrally and continuously in the peripheral direction. Therefore, the existence of this continued peripheral wall portion can further increase the strength of the die case 20, which in turn can further increase the strength of the entire extrusion molding die. Accordingly, there exists no portion weak in strength, such as a conventional bridge portion, and it is not required to increase the size, such as, e.g., the thickness, beyond the necessity for the purpose of increasing the strength, which makes it possible to attain the size and weight reduction as well as the cost reduction.

Furthermore, in this embodiment, the portholes 24 and 24 are formed at positions away from the central axis X1 of the pressure receiving portion 21, i.e., at the external periphery of the pressure receiving portion 21, and the central axis X2 of each porthole 24 is inclined with respect to the central axis X1 of the die case 20 so as to gradually approach the central axis X1 of the die case 20 toward the downstream side. Therefore, the metal material passing through the portholes 24 and 24 can be stably extruded while being smoothly introduced toward the central axis X1, i.e., the extrusion hole 11. Furthermore, in this embodiment, since the downstream side end portions (outlets) of the portholes 24 and 24 are arranged so as to face to the extrusion hole 11, the metal material can be more smoothly introduced into the extrusion hole 11.

Furthermore, in this embodiment, since the portholes 24 and 24 are arranged at both sides of the height direction (thickness direction) of the flat extrusion hole 11, the metal material can be more smoothly introduced into the extrusion hole 11 in a stable manner from both the thickness sides. Accordingly, the metal material will be extruded while evenly passing through the entire area of the extrusion hole 11 in a well-balanced manner, to thereby obtain a high quality extrusion molded hollow member 60.

Especially like in the embodiment, even in the case of extruding a hollow member 60 having a complicated configuration such as a flat harmonica-tube shape, the metal material can be introduced into the entire region of the extrusion hole 11 in a balanced manner, which makes it possible to assuredly maintain the high quality.

For reference, in the case of manufacturing an aluminum heat exchanging tube (hollow member) provided with a plurality of passages 63 each rectangular in cross-section having a height of 0.5 mm and a width of 0.5 mm and arranged in parallel, in a conventional extrusion molding die, since the strength was insufficient, cracks generated in the male die became a factor of shortening the die life. On the other hand, in the extrusion molding die 10 according to the present invention, since the strength is sufficient, no crack will be generated in the male die 30. Therefore, the abrasion of the male die 30 becomes a factor of the die life, which can remarkably improve the die life.

For example, according to the results of experiments relevant to a die life performed by the present inventors, in the extrusion molding die according to the present invention, the die life could be extended sufficiently as compared with a conventional one.

Moreover, in the present invention, since it has sufficient pressure resistance (strength), the extrusion limit speed can be raised considerably. For example, in a conventional extrusion molding die, the upper limit of the extrusion speed was 60 m/min. On the other hand, in the extrusion molding die according to the present invention, the upper limit of the extrusion speed can be raised up to 150 m/min, i.e., the extrusion limit speed can be raised about 2.5 times, and therefore the further improved productive efficiency can be expected.

Second Embodiment

FIGS. 14 to 17 show an extrusion molding die according to a second embodiment of the present invention. As shown in these figures, the extrusion molding die 10 of this second embodiment is used to extrude a tubular member circular in cross-section, which is different from the extrusion molding die 10 of the first embodiment configured to extrude a flat extrusion molded tube.

That is, three portholes 24 are formed in the peripheral wall of the pressure receiving portion 21 of the die case 20 at equal intervals in the circumferential direction about the central axis. In the same manner as mentioned above, each porthole 24 is arranged such that each porthole 24 approaches the central axis of the pressure receiving portion 21 at it advances toward the downstream side so that the central axis of the porthole 24 intersects with and is inclined to the central axis of the pressure receiving portion 21. The optimum range of the inclination angle of the porthole central axis to the central axis of the pressure receiving portion 21 is the same as mentioned above.

Furthermore, the male die 30 has a round mandrel 31, and the female die 40 has a round die hole 41.

Furthermore, the die holding hole 23 of the die case 20 is formed into a cylindrical column shape corresponding to the male die 30.

The mandrel 31 of the male die 30 is disposed in the die hole 41 of the female die 40, so that a circular ring shaped extrusion hole 11 is formed by and between the mandrel 31 and the die hole 41.

In this second embodiment, in the same manner as in the aforementioned first embodiment, the size ratio of each portion is adjusted.

Figure 16:
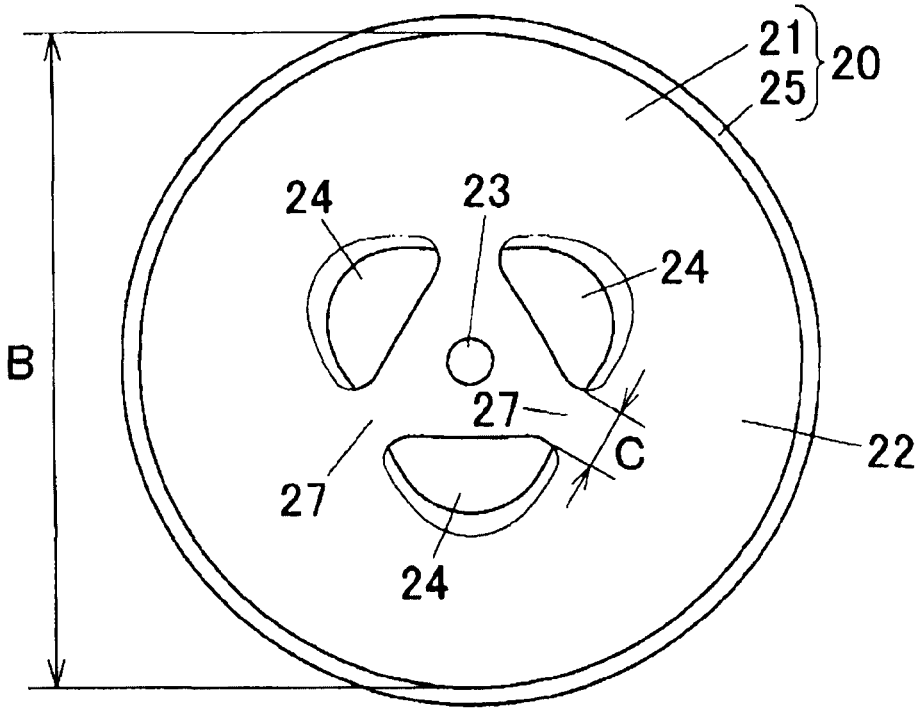
FIG. 16 is a rear (front) view showing a die case of the extrusion molding die.

That is, assuming that the diameter of the circumscribed circle of the round tubular member as an extrusion molded product is defined as "A" (product circumscribed circle diameter) and the pressure receiving surface external diameter is defined as "B" as shown in FIG. 16, in the same reasons as mentioned above, it is required to adjust "B/A" to 1.8 to 6.0 (B/A=1.8 to 6.0), preferably 2.0 to 5.0, more preferably 2.0 to 4.5.

Furthermore, as shown in FIG. 16, assuming that the porthole inlet side minimum thickness size of the between-hole-wall 27 formed by the wall portion between the adjacent portholes 24 in the circumferential direction is defined as "C" (between-hole-wall inlet side minimum thickness size), and the between-hole-wall inlet side total thickness size obtained by multiplying the number "n" of the between-hole-walls 27 by the between-hole-wall inlet side minimum thickness size "C" is defined as "D," it is required to adjust D/B to 0.15 to 0.4 (D/B=0.15–0.4), preferably 0.15 to 0.35, more preferably 0.15 to 0.3. In the second embodiment, the number "n" of the between-hole-walls 27 is "3."

Figure 17:
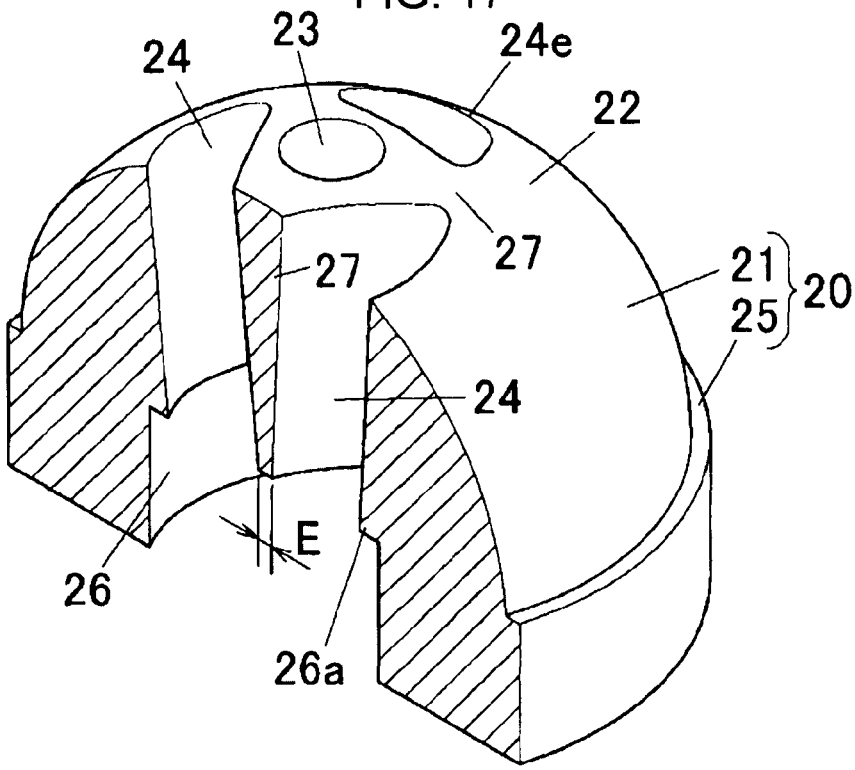
FIG. 17 is a cut-out perspective view of the die case.
Figure 18A:
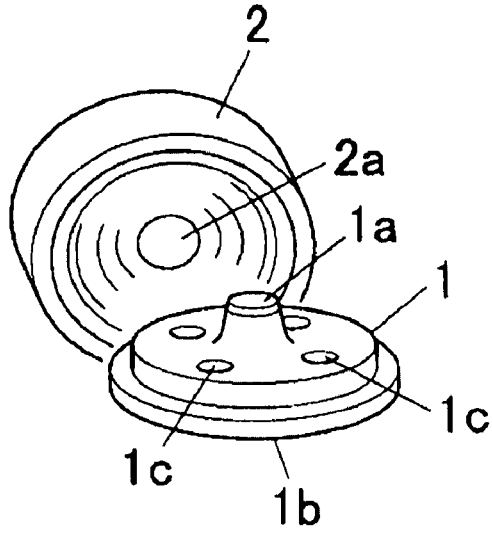
FIG. 18A is an exploded perspective view of a porthole die as a conventional extrusion molding die.
Figure 18B:
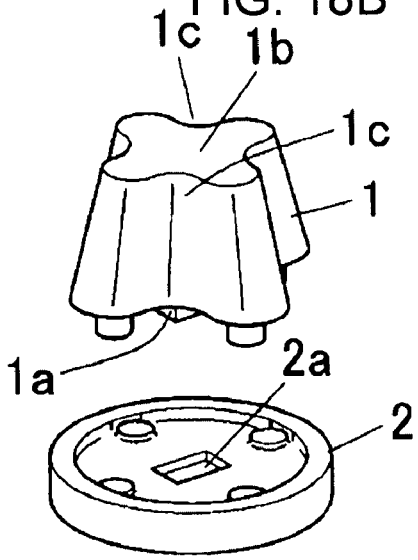
PRIOR ART FIG. 18B
FIG. 18B is an exploded perspective view showing a spider die as a conventional extrusion molding die.
Figure 18C:
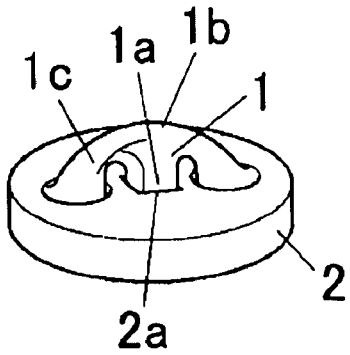
PRIOR ART FIG. 18C
FIG. 18C is an exploded perspective view showing a bridge die as a conventional extrusion molding die.

Furthermore, as shown in FIG. 17, when the between-hole-wall outlet side minimum thickness size is defined as "E," by the same reasons as mentioned above, it is preferable to adjust E/C to 0.15 to 1.0 (E/C=0.15-1.0), preferably 0.15 to 0.8, more preferably 0.15 to 0.7.

The other structure of the extrusion molding die 10 of this second embodiment is essentially the same as that of the extrusion molding die 10 of the aforementioned first embodiment, and therefore the cumulative explanation will be omitted by allotting the same reference numeral to the same or corresponding portion.

Figure 10:
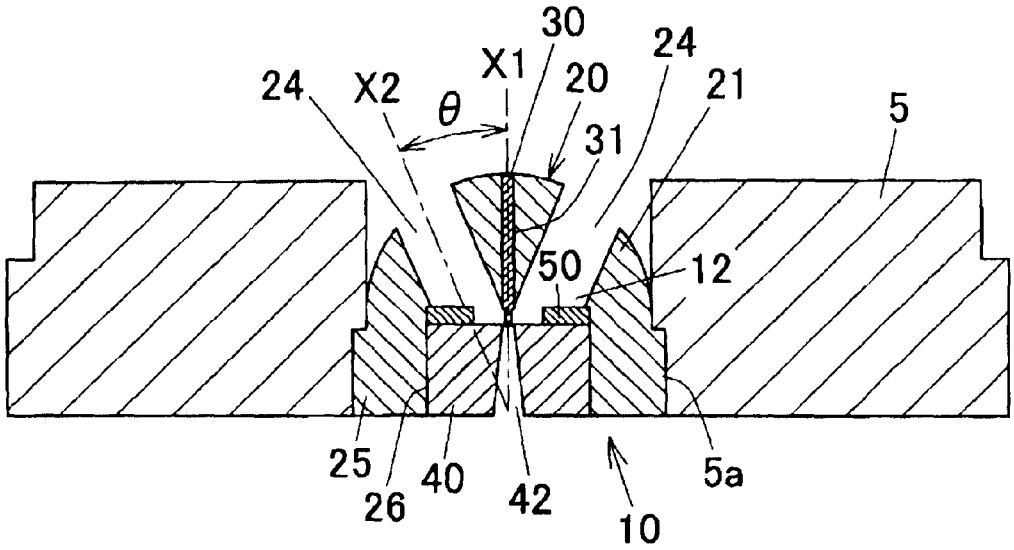
FIG. 10 is one side cross-sectional view of the vicinity of the die mounted in the extruder.
Figure 11:
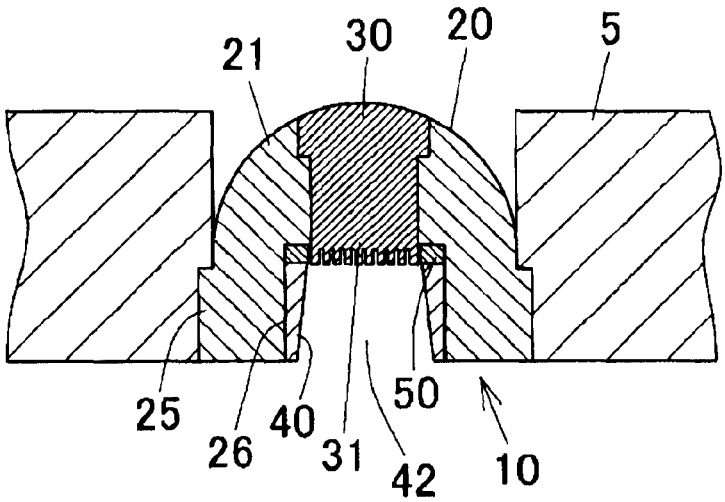
FIG. 11 is another cross-sectional view of the vicinity of the die mounted in the extruder.

Also in the extrusion molding die 10 of this second embodiment, it is set to the same extruder as in the first embodiment as shown in FIGS. 9 to 11 to perform extrusion molding to thereby produce a tubular member around in cross-section.

Also in this second embodiment, in the same manner as mentioned above, the same effects can be obtained. Moreover, in this second embodiment, three portholes 24 are formed at equal intervals in the circumferential direction, and therefore it is possible to introduce metal material into the die case from its peripheral direction equally in a balanced manner. Accordingly, the metal material can be smoothly introduced into the extrusion hole 11 without difficulty, enabling extrusion in a more stable manner, which in turn can obtain an extrusion molded product with higher quality.

Modified Embodiment

In the aforementioned embodiment, the pressure receiving portion 21 is formed to have a hemispherical convex shape. In the present invention, however, the configuration of the pressure receiving portion (pressure receiving surface) is not limited to it.

For example, the pressure receiving surface can be formed into a polyhedral configuration constituted by a number of sides. In other words, it can be formed into a polyhedral configuration such as a multi-sided pyramid in which a plurality of sides are arranged in the peripheral direction or a polyhedral configuration in which a plurality of sides are arranged in the radial direction. In the above cases, each side constituting the pressure receiving surface can be flat or curved.

Furthermore, the pressure receiving portion can be formed into a laterally extended configuration in which the lateral directional length is longer than the lengthwise directional length, the lateral direction and the vertical direction being perpendicular to the axial direction, such as, e.g., a laterally elongated elliptical configuration as seen from the upstream side of the axial direction or a laterally elongated oval configuration as seen from the upstream side of the axial direction.

The pressure receiving portion can be formed into a configuration having a protrusion size along the axial direction longer than the size of the radial direction perpendicular to the axial direction, e.g., a semi-elliptical configuration obtained by halving an elliptical configuration in the major axis direction.

Furthermore, in the aforementioned embodiment, the die case 20 is integrally formed. In the present invention, however, it is not limited to it and can be constituted such that the die case can be divided into two members. For example, it can be constituted such that the die case consists of two members, i.e., a male die case for holding a male die and a female die case for holding a female die.

Furthermore, in the aforementioned embodiment, the male die, the female die and the flow control plate are formed separately from the die case. The present invention, however, is not limited to the above, and can be constituted such that at least one of the male die, the female die and the flow control plate is formed integrally with the die case. Furthermore, in the present invention, the flow control plate can be omitted as needed.

Furthermore, in the aforementioned embodiment, the explanation is directed to the case in which two or three portholes are formed. However, the present invention is not limited to the above. In the present invention, it can be constituted that four or more portholes are formed.

Especially in the case of extruding a tubular member round in cross-section, it is preferable that three or more portholes are formed at equal intervals in the circumferential direction.

Furthermore, in the present invention, the configuration of the porthole inlet is not specifically limited. It can be configured such that portholes are different in configuration from each other.

Furthermore, in the present invention, it can be formed such that the opening area of the porthole inlet is larger than the passage cross-sectional area of the inside portion the porthole.

Furthermore, in the aforementioned embodiment, the base portion is formed at the front end portion of the die case. In the present invention, however, it is not necessarily required to provide such a base portion.

In the aforementioned embodiment, although the explanation is directed to the case in which a single extrusion molding die is set in a container, the present invention is not limited to the above. In the present invention, two or more extrusion molding dies can be set in a container.

EXAMPLES

TABLE 1

| | B/A | D/B | E/C | Die life (ton/die) | Die life limiting factor | Extrusion load ($\times 10^4$N) |
|---|---|---|---|---|---|---|
| Example 1-1 | 1.8 | 0.3 | 0.2 | 3.0 | Abrasion of male die, minute cracks in the male die | 1,500 |
| Example 1-2 | 2.0 | 0.3 | 0.2 | 3.2 | Abrasion of male die | 1,500 |
| Example 1-3 | 3.0 | 0.3 | 0.2 | 3.2 | Abrasion of male die | 1,500 |
| Example 1-4 | 4.0 | 0.3 | 0.2 | 3.2 | Abrasion of male die | 1,530 |
| Example 1-5 | 4.5 | 0.3 | 0.2 | 3.2 | Abrasion of male die | 1,550 |
| Example 1-6 | 5.0 | 0.3 | 0.2 | 3.1 | Abrasion of male die | 1,570 |
| Example 1-7 | 5.5 | 0.3 | .02 | 3.0 | Abrasion of male die | 1,570 |
| Example 1-8 | 6.0 | 0.3 | 0.2 | 3.0 | Abrasion of male die | 1,600 |
| Comparative Example 1-1 | 1.5 | 0.3 | 0.2 | 2.4 | Abrasion of male die, minute cracks in the male die | 1,450 |
| Comparative Example 1-2 | 7.0 | 0.3 | 0.2 | 2.8 | Abrasion of male die, minute cracks in the male die | 1,720 |

Example 1-1

An extrusion molding die 10 corresponding to the aforementioned first embodiment shown in FIGS. 1 to 8 was prepared. In the male die 30 of this die 10, it was regulated such that the mandrel 31 was 2.0 mm in thickness, and 19.2 mm in width, the passage forming protruded portion 33 was 1.2 mm in height and 0.6 mm in width, and the partition forming groove was 0.2 mm in width.

In the female die 20, it was adjusted such that the die hole 41 was 1.7 mm in height and 20.0 mm in width.

In the die case 20, two portholes 24 were formed at both sides of the thickness direction of the extrusion hole 11. The inclination angle θ of each porthole 24 was adjusted to 10°. That is, the inclination angle θ of the axial center X2 of each porthole 24 with respect to the axial center X1 of the die case 20 was adjusted to 10° and the inner and outer side surfaces 24*a* and 24*b* among the inner peripheral surface of each porthole 24 were arranged in parallel with each other.

The billet pressure receiving surface 22 was formed into an external spherical surface (protruded spherical surface) of a ½ sphere with radius 30 mm.

Furthermore, as shown in Table 1, the ratio (B/A) of the pressure receiving surface external diameter B to the product circumscribed circle diameter A was adjusted to 1.8; the ratio D/B of the between-hole-wall inlet side total thickness size D to the pressure receiving surface external diameter B was adjusted to 0.3; and the ratio E/C of the between-hole-wall outlet side minimum thickness size E to the between-hole-wall inlet side minimum thickness size C was adjusted to 0.2.

The extrusion molding die 10 structured as mentioned above was set to the extruder similar to that of the aforementioned embodiment as shown in FIGS. 9 to 11, and extrusion molding was performed to produce a flat multi-passage tubular member (heat exchanging tubular member) made of aluminum alloy as shown in FIGS. 12 and 13.

The die life (the amount (tons) of material introduced until cracks or abrasion occurred in the die) and the extrusion load were measured. Furthermore, the die life limiting factors were investigated. The results are shown in Table 1.

Example 1-2

The ratio (B/A) of the pressure receiving surface external diameter B to the product circumscribed circle diameter A was adjusted to 2.0 as shown in Table 1.

Preparing an extrusion molding die 10 having the same structure as mentioned above except for the above-mentioned structure, extrusion molding and evaluation were performed in the same manner as mentioned above.

Example 1-3

The ratio (B/A) of the pressure receiving surface external diameter B to the product circumscribed circle diameter A was adjusted to 3.0 as shown in Table 1.

Preparing an extrusion molding die 10 having the same structure as mentioned above except for the above-mentioned structure, extrusion molding and evaluation were performed in the same manner as mentioned above.

Example 1-4

The ratio (B/A) of the pressure receiving surface external diameter B to the product circumscribed circle diameter A was adjusted to 4.0 as shown in Table 1.

Preparing an extrusion molding die 10 having the same structure as mentioned above except for the above-mentioned structure, extrusion molding and evaluation were performed in the same manner as mentioned above.

Example 1-5

The ratio (B/A) of the pressure receiving surface external diameter B to the product circumscribed circle diameter A was adjusted to 4.5 as shown in Table 1.

Preparing an extrusion molding die 10 having the same structure as mentioned above except for the above-mentioned structure, extrusion molding and evaluation were performed in the same manner as mentioned above.

Example 1-6

The ratio (B/A) of the pressure receiving surface external diameter B to the product circumscribed circle diameter A was adjusted to 5.0 as shown in Table 1.

Preparing an extrusion molding die 10 having the same structure as mentioned above except for the above-mentioned structure, extrusion molding and evaluation were performed in the same manner as mentioned above.

Example 1-7

The ratio (B/A) of the pressure receiving surface external diameter B to the product circumscribed circle diameter A was adjusted to 5.5 as shown in Table 1.

Preparing an extrusion molding die 10 having the same structure as mentioned above except for the above-mentioned structure, extrusion molding and evaluation were performed in the same manner as mentioned above.

Example 1-8

The ratio (B/A) of the pressure receiving surface external diameter B to the product circumscribed circle diameter A was adjusted to 6.0 as shown in Table 1.

Preparing an extrusion molding die 10 having the same structure as mentioned above except for the above-mentioned structure, extrusion molding and evaluation were performed in the same manner as mentioned above.

Comparative Example 1-1

The ratio (B/A) of the pressure receiving surface external diameter B to the product circumscribed circle diameter A was adjusted to 1.5 as shown in Table 1.

Preparing an extrusion molding die 10 having the same structure as mentioned above except for the above-mentioned structure, extrusion molding and evaluation were performed in the same manner as mentioned above.

Comparative Example 1-2

The ratio (B/A) of the pressure receiving surface external diameter B to the product circumscribed circle diameter A was adjusted to 7.0 as shown in Table 1.

Preparing an extrusion molding die 10 having the same structure as mentioned above except for the above-mentioned structure, extrusion molding and evaluation were performed in the same manner as mentioned above.

<Evaluation 1>

As shown in Table 1, in Examples, abrasion of the male die was a die life limiting main factor and the die life was long. In Example 1-1, although minute cracks were included as a die life limiting factor, the extrusion load was low, and the die life was relatively long.

On the other hand, in Comparative Examples, in addition to abrasion of the male die, minute cracks were one of die life limiting factors, and the die life was short. Among other things, in Comparative Example 1-1, the die life was considerably short because of the lack of strength. In Comparative Example 1-2, although the strength was sufficient, the extrusion load became large, which caused short die life.

TABLE 2

| | B/A | D/B | E/C | Die life (ton/die) | Die life limiting factor | Extrusion load ($\times 10^4$N) |
|---|---|---|---|---|---|---|
| Example 2-1 | 2.5 | 0.15 | 0.2 | 3.2 | Abrasion of male die | 1,500 |
| Example 2-2 | 2.5 | 0.2 | 0.2 | 3.2 | Abrasion of male die | 1,500 |
| Example 2-3 | 2.5 | 0.3 | 0.2 | 3.2 | Abrasion of male die | 1,500 |
| Example 2-4 | 2.5 | 0.35 | 0.2 | 3.2 | Abrasion of male die | 1,540 |
| Example 2-5 | 2.5 | 0.4 | 0.2 | 3.2 | Abrasion of male die | 1,600 |
| Comparative Example 2-1 | 2.5 | 0.1 | 0.2 | 2.0 | Minute cracks in the male die | 1,450 |
| Comparative Example 2-2 | 2.5 | 0.45 | 0.2 | 3.0 | Abrasion of male die, minute cracks in the male die | 1,760 |

Example 2-1

The ratio (B/A) of the pressure receiving surface external diameter B to the product circumscribed circle diameter A was adjusted to 2.5 as shown in Table 2, the ratio D/B of the between-hole-wall inlet side total thickness size D to the pressure receiving surface external diameter B was adjusted to 0.15; and the ratio E/C of the between-hole-wall outlet side minimum thickness size E to the between-hole-wall inlet side minimum thickness size C was adjusted to 0.2.

Preparing an extrusion molding die 10 having the same structure as mentioned above except for the above-mentioned structure, extrusion molding and evaluation were performed in the same manner as mentioned above.

Example 2-2

The ratio D/B of the between-hole-wall inlet side total thickness size D to the pressure receiving surface external diameter B was adjusted to 0.2 as shown in Table 2.

Preparing an extrusion molding die 10 having the same structure as mentioned above except for the above-mentioned structure, extrusion molding and evaluation were performed in the same manner as mentioned above.

Example 2-3

The ratio D/B of the between-hole-wall inlet side total thickness size D to the pressure receiving surface external diameter B was adjusted to 0.3 as shown in Table 2.

Preparing an extrusion molding die 10 having the same structure as mentioned above except for the above-mentioned structure, extrusion molding and evaluation were performed in the same manner as mentioned above.

Example 2-4

The ratio D/B of the between-hole-wall inlet side total thickness size D to the pressure receiving surface external diameter B was adjusted to 0.35 as shown in Table 2.

Preparing an extrusion molding die 10 having the same structure as mentioned above except for the above-mentioned structure, extrusion molding and evaluation were performed in the same manner as mentioned above.

Example 2-5

The ratio D/B of the between-hole-wall inlet side total thickness size D to the pressure receiving surface external diameter B was adjusted to 0.4 as shown in Table 2.

Preparing an extrusion molding die 10 having the same structure as mentioned above except for the above-mentioned structure, extrusion molding and evaluation were performed in the same manner as mentioned above.

Comparative Example 2-1

The ratio D/B of the between-hole-wall inlet side total thickness size D to the pressure receiving surface external diameter B was adjusted to 0.1 as shown in Table 2.

Preparing an extrusion molding die 10 having the same structure as mentioned above except for the above-mentioned structure, extrusion molding and evaluation were performed in the same manner as mentioned above.

Comparative Example 2-2

The ratio D/B of the between-hole-wall inlet side total thickness size D to the pressure receiving surface external diameter B was adjusted to 0.45 as shown in Table 2.

Preparing an extrusion molding die 10 having the same structure as mentioned above except for the above-mentioned structure, extrusion molding and evaluation were performed in the same manner as mentioned above.

<Evaluation 2>

As shown in Table 2, in Examples, abrasion of the male die was a die life limiting main factor and the die life was long.

On the other hand, in Comparative Example 2-1, minute cracks in the male die were the die life limiting factor, and the die life was short. In Comparative Example 2-2, the extrusion load was large, and the die life was short.

TABLE 3

| | B/A | D/B | E/C | Die life (ton/die) | Die life limiting factor | Extrusion load ($\times 10^4$N) |
|---|---|---|---|---|---|---|
| Example 3-1 | 2.5 | 0.3 | 0.15 | 3.1 | Abrasion of male die | 1,500 |
| Example 3-2 | 2.5 | 0.3 | 0.2 | 3.2 | Abrasion of male die | 1,500 |
| Example 3-3 | 2.5 | 0.3 | 0.4 | 3.2 | Abrasion of male die | 1,500 |
| Example 3-4 | 2.5 | 0.3 | 0.6 | 3.2 | Abrasion of male die | 1,540 |
| Example 3-5 | 2.5 | 0.3 | 0.7 | 3.2 | Abrasion of male die | 1,550 |
| Example 3-6 | 2.5 | 0.3 | 0.8 | 3.1 | Abrasion of male die | 1,600 |
| Example 3-7 | 2.5 | 0.3 | 0.9 | 3.1 | Abrasion of male die | 1,700 |
| Example 3-8 | 2.5 | 0.3 | 1.0 | 3.1 | Abrasion of male die | 1,750 |
| Comparative Example 3-1 | 2.5 | 0.3 | 0.1 | 2.6 | Minute cracks in the male die | 1,500 |
| Comparative Example 3-2 | 2.5 | 0.3 | 1.1 | 3.1 | Abrasion of male die | 1,800 |

Example 3-1

As shown in Table 3, the ratio (B/A) of the pressure receiving surface external diameter B to the product circumscribed circle diameter A was adjusted to 2.5, the ratio D/B of the between-hole-wall inlet side total thickness size D to the pressure receiving surface external diameter B was adjusted to 0.3; and the ratio E/C of the between-hole-wall outlet side minimum thickness size E to the between-hole-wall inlet side minimum thickness size C was adjusted to 0.15.

Preparing an extrusion molding die 10 having the same structure as mentioned above except for the above-mentioned structure, extrusion molding and evaluation were performed in the same manner as mentioned above.

Example 3-2

The ratio E/C of the between-hole-wall outlet side minimum thickness size E to the between-hole-wall inlet side minimum thickness size C was adjusted to 0.2 as shown in Table 3.

Preparing an extrusion molding die 10 having the same structure as mentioned above except for the above-mentioned structure, extrusion molding and evaluation were performed in the same manner as mentioned above.

Example 3-3

The ratio E/C of the between-hole-wall outlet side minimum thickness size E to the between-hole-wall inlet side minimum thickness size C was adjusted to 0.4 as shown in Table 3.

Preparing an extrusion molding die 10 having the same structure as mentioned above except for the above-mentioned structure, extrusion molding and evaluation were performed in the same manner as mentioned above.

Example 3-4

The ratio E/C of the between-hole-wall outlet side minimum thickness size E to the between-hole-wall inlet side minimum thickness size C was adjusted to 0.6 as shown in Table 3.

Preparing an extrusion molding die 10 having the same structure as mentioned above except for the above-mentioned structure, extrusion molding and evaluation were performed in the same manner as mentioned above.

Example 3-5

The ratio E/C of the between-hole-wall outlet side minimum thickness size E to the between-hole-wall inlet side minimum thickness size C was adjusted to 0.7 as shown in Table 3.

Preparing an extrusion molding die 10 having the same structure as mentioned above except for the above-mentioned structure, extrusion molding and evaluation were performed in the same manner as mentioned above.

Example 3-6

The ratio E/C of the between-hole-wall outlet side minimum thickness size E to the between-hole-wall inlet side minimum thickness size C was adjusted to 0.8 as shown in Table 3.

Preparing an extrusion molding die 10 having the same structure as mentioned above except for the above-mentioned structure, extrusion molding and evaluation were performed in the same manner as mentioned above.

Example 3-7

The ratio E/C of the between-hole-wall outlet side minimum thickness size E to the between-hole-wall inlet side minimum thickness size C was adjusted to 0.9 as shown in Table 3.

Preparing an extrusion molding die 10 having the same structure as mentioned above except for the above-mentioned structure, extrusion molding and evaluation were performed in the same manner as mentioned above.

Example 3-8

The ratio E/C of the between-hole-wall outlet side minimum thickness size E to the between-hole-wall inlet side minimum thickness size C was adjusted to 1.0 as shown in Table 3. Only in this example, the inclination angle of the inner side surface 24*a* among the inner peripheral surface of each porthole 24 was adjusted to 0° with respect to the axial center X1 of the die case 20.

Preparing an extrusion molding die 10 having the same structure as mentioned above except for the above-mentioned structure, extrusion molding and evaluation were performed in the same manner as mentioned above.

Comparative Example 3-1

The ratio E/C of the between-hole-wall outlet side minimum thickness size E to the between-hole-wall inlet side minimum thickness size C was adjusted to 0.1 as shown in Table 3.

Preparing an extrusion molding die 10 having the same structure as mentioned above except for the above-mentioned structure, extrusion molding and evaluation were performed in the same manner as mentioned above.

Comparative Example 3-2

The ratio E/C of the between-hole-wall outlet side minimum thickness size E to the between-hole-wall inlet side minimum thickness size C was adjusted to 1.1 as shown in Table 3. Furthermore, only in this comparative example, the inner side surface 24*a* of the inner peripheral surface of each porthole 24 was inclined by 10° with respect to the axial center X1 of the die case 20 so as to get away from the axial center X1 of the die case 20 as it advances toward the downstream side.

Preparing an extrusion molding die 10 having the same structure as mentioned above except for the above-mentioned structure, extrusion molding and evaluation were performed in the same manner as mentioned above.

<Evaluation 3>

As shown in Table 3, in Examples, abrasion of the male die was a die life limiting factor and the die life was long.

On the other hand, in Comparative Example 3-1, minute cracks in the male die was the die life limiting factor, and the die life was slightly shorter than that of Examples. In Comparative Example 3-2, although the extrusion load was large, a die life nearly equal to that of Example was obtained.

TABLE 4

| | Spherical size of billet pressure receiving surface | Die life (ton/die) |
|---|---|---|
| Example 4-1 | ⅛ | 1.2 |
| Example 4-2 | ⅙ | 2.0 |
| Example 4-3 | ⅓ | 2.5 |
| Example 4-4 | ½ | 3.2 |
| Example 4-5 | ⅔ | 3.2 |
| Example 4-6 | ⅚ | 3.2 |

Example 4-1

An extrusion molding die 10 corresponding to the aforementioned first embodiment shown in FIGS. 1 to 8 was prepared. As shown in Table 4, a die case 20 for this die 10 in which the billet pressure receiving surface 22 was formed into a ⅛ spherical configuration (protruded spherical surface) having a radius of 45.4 mm was prepared. The diameter of this pressure receiving portion 21 was adjusted to 60 mm.

Furthermore, two portholes 24 were formed at the both thickness sides of the extrusion hole 11 in the die case 20. The inclination angle θ of each porthole 24 was adjusted to 10°.

As a male die, a male die 30 in which the height (thickness) of the mandrel 31 was adjusted to 2.0 mm, the width of the mandrel 31 was adjusted to 19.2 mm, the height of the passage forming protruded portion 33 was adjusted to 1.2 mm, the width of the passage forming protruded portion 33 was adjusted to 0.6 mm, and the width of the partition forming groove 32 was adjusted to 0.2 mm. Furthermore, as a female die, a female die 40 in which the height of the die hole 41 was adjusted to 1.7 mm and the width of the die hole 41 was adjusted to 20.0 mm.

Furthermore, in this die 10, the ratio (B/A) of the pressure receiving surface external diameter B to the product circumscribed circle diameter A was adjusted to 3.0, the ratio D/B of the between-hole-wall inlet side total thickness size D to the pressure receiving surface external diameter B was adjusted to 0.3; and the ratio E/C of the between-hole-wall outlet side minimum thickness size E to the between-hole-wall inlet side minimum thickness size C was adjusted to 0.2.

As shown in FIGS. 9 to 11, the extrusion molding die 10 was set to an extruder similar to the extruder shown in the first embodiment, and extrusion was performed to produce a flat multi-passage tubular member (heat exchanging tubular member) as shown in FIGS. 12 and 13.

Die life (ton/die) was measured. The results are shown in Table 4.

Example 4-2

As shown in Table 4, an extrusion molding die 10 which was the same as the extrusion molding die of Example 4-1 except that the billet pressure receiving surface 22 was constituted by a ⅙ spherical surface and the radius was set to 40.3 mm was prepared. The extrusion molding die 10 was set to the same extruder as mentioned above, and extrusion was performed to produce a flat multi-passage tubular member.

Example 4-3

As shown in Table 4, an extrusion molding die 10 which was the same as the extrusion molding die of Example 4-1 except that the billet pressure receiving surface 22 was constituted by a ⅓ convex spherical surface and the radius was set to 32.0 mm was prepared. The extrusion molding die 10 was set to the same extruder as mentioned above and extrusion was performed to produce a flat multi-passage tubular member.

Example 4-4

As shown in Table 4, an extrusion molding die 10 which was the same as the extrusion molding die of Example 4-1 except that the billet pressure receiving surface 22 was constituted by a ½ convex spherical surface and the radius was set to 30.0 mm was prepared. The extrusion molding die 10 was set to the same extruder as mentioned above and extrusion was performed to produce a flat multi-passage tubular member.

Example 4-5

As shown in Table 4, an extrusion molding die 10 which was the same as the extrusion molding die of Example 4-1 except that the billet pressure receiving surface 22 was constituted by a ⅘ convex spherical surface and the radius was set to 32.0 mm was prepared. The extrusion molding die 10 was set to the same extruder as mentioned above and extrusion was performed to produce a flat multi-passage tubular member.

Example 4-6

As shown in Table 4, an extrusion molding die 10 which was the same as the extrusion molding die of Example 4-1 except that the billet pressure receiving surface 22 was constituted by a ⅚ convex spherical surface and the radius was set to 40.3 mm was prepared. The extrusion molding die 10 was set to the same extruder as mentioned above and extrusion was performed to produce a flat multi-passage tubular member.

<Evaluation 4>

As shown in Table 4, in the die (Example 4-1) in which the spherical radius of the billet pressure receiving surface 22 was large and the protruded amount thereof was relatively small, the die life was slightly short.

Furthermore, in the die (Example 4-6) in which the spherical radius of the billet pressure receiving surface 22 was small and the protruded amount thereof was relatively large, it is considered that although a long die life can be secured, it may be slightly difficult to process the billet pressure receiving surface 22.

To the contrary, in the die (Examples 4-2 to 4-5) in which the pressure receiving surface 22 was formed into an appropriate convex configuration, i.e., a ⅙ to ⅘ convex spherical configuration, the die life could be extended and the die production cost could be reduced. Among other things, in the die (Example 4-4) in which the billet pressure receiving surface 22 was formed into a ½ convex spherical configuration, the die production cost could be reduced while keeping sufficient long die life, which was excellent in result.

Comparing with the die of Example 4-4, in the die (Example 4-5) in which the billet pressure receiving surface 22 was formed into a ⅘ convex spherical configuration, the die production cost slightly increased and the results were slightly not good among the dies of Examples 4-2 to 4-5.

This application claims priority to Japanese Patent Application No. 2007-20339 filed on Jan. 31, 2007, and Japanese Patent Application No. 2007-56841 filed on Mar. 7, 2007, and the entire disclosures of which are incorporated herein by reference in their entirety.

It should be understood that the terms and expressions used herein are used for explanation and have no intention to be used to construe in a limited manner, do not eliminate any equivalents of features shown and mentioned herein, and allow various modifications falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

INDUSTRIAL APPLICABILITY

The extrusion molding die according to the present invention can be preferably used in manufacturing an extrusion molded product, such as, e.g., a hollow tube, more specifically, a heat exchanging tube for use in, e.g., automobile air-conditioning gas coolers, evaporators, household hot-water supplying apparatuses.

The invention claimed is:

1. An extrusion molding die for metal material, comprising:

a die case having a pressure receiving portion with an outer surface functioning as a metal material pressure receiving surface, wherein the die case is disposed so that the metal material pressure receiving surface faces rearward so as to oppose to an extrusion direction of the metal material;

a male die mounted in the die case; and a female die mounted in the die case so as to form an extrusion hole by and between the female die and the male die, wherein the pressure receiving surface is formed into a rearwardly protruded convex shape, and a plurality of metal material introducing portholes are formed in an external periphery of the pressure receiving portion at intervals in a circumferential direction around an axial center of the die case, wherein it is configured such that the metal material pressed against the metal material pressure receiving surface is introduced into the die case via the portholes and passes through the extrusion hole, and wherein B/A is adjusted to 1.8 to 6.0 and D/B is adjusted to 0.15 to 0.4, where "A" (product circumscribed circle diameter) is a diameter of a minimum circumscribed circle of a cross-section of an extrusion molded product, "B" (pressure receiving surface external diameter) is an external diameter of the metal material pressure receiving surface, "C" (between-hole-wall inlet side minimum thickness size) is a porthole inlet side minimum thickness size of a between-hole-wall formed by a wall portion between a pair of adjacent portholes, "n" is the number of the between-hole-walls, and "D" is a between-hole-wall inlet side total thickness size obtained by multiplying the number "n" of the between-hole-walls by the between-hole-wall inlet side minimum thickness size "C."

2. The extrusion molding die for metal material as recited in claim 1, wherein E/C is adjusted to 0.15 to 1.0, where "E" (between-hole-wall outlet side minimum thickness size) is a porthole outlet side minimum thickness size of the between-hole-wall.

3. The extrusion molding die for metal material as recited in claim 1 or 2, wherein the portholes are arranged at equal intervals around an axial center of the die case.

4. The extrusion molding die for metal material as recited in claim 1 or 2, wherein the pressure receiving surface of the die case is formed into a convex spherical surface constituted by a part of a spherical surface.

5. The extrusion molding die for metal material as recited in claim 1 or 2, wherein an inclination angle of an axial center of the porthole is set to 3 to 45° with respect to an axial center of the die case.

6. The extrusion molding die for metal material as recited in claim 1 or 2, wherein the extrusion hole is formed into a flat shape with a width larger than a height (thickness), and wherein the portholes are formed at positions corresponding to both thickness sides of the extrusion hole.

7. The extrusion molding die for metal material as recited in claim 1 or 2, wherein a flat circular extrusion hole with a width larger than a height (thickness) is formed by and between the male die and the female die, wherein a portion of the male die corresponding to the extrusion hole is formed into a comb-like configuration having a plurality of passage forming protrusions arranged in a width direction, and wherein a multi-passage hollow member having a plurality of passages arranged in a width direction is formed when metal material passes through the extrusion hole.

8. The extrusion molding die as recited in claim 1 or 2, wherein the male die and the female die form a circular extrusion hole, and wherein a tubular member circular in cross-section is formed when metal material passes through the extrusion hole.

9. The extrusion molding die as recited in claim 1 or 2, wherein the metal material pressure receiving surface is constituted by a convex spherical surface of a ⅙ sphere to a ⅘ sphere.

10. The extrusion molding die as recited in claim 1 or 2, wherein the metal material is aluminum or its alloy.

11. A production method of an extrusion molded article, wherein the extrusion molded article is formed using the extrusion molding die as recited in claim 1 or 2.

12. A production method of a multi-passage hollow member, wherein the multi-passage hollow member is formed using the extrusion molding die as recited in claim 7.

13. A production method of a tubular member circular in cross-section, wherein the tubular member is formed using the extrusion molding die as recited in claim 8.

14. A die case for an extrusion molding die, comprising a pressure receiving portion with an outer surface functioning as a metal material pressure receiving surface, wherein the die case is disposed so that the metal material pressure receiving surface faces rearward so as to oppose to an extrusion direction of the metal material, and a male die and a female die are mounted in the die case, wherein the pressure receiving surface is formed into a rearwardly protruded convex shape, and a plurality of metal material introducing portholes are formed in an external periphery of the pressure receiving portion at intervals in a circumferential direction around an axial center of the die case, wherein it is configured such that the metal material pressed against the metal material pressure receiving surface is introduced into the die case via the portholes, and wherein B/A is adjusted to 1.8 to 6.0 and D/B is adjusted to 0.15 to 0.4, where "A" (product circumscribed circle diameter) is a diameter of a minimum circumscribed circle of a cross-section of an extrusion molded product, "B" (pressure receiving surface external diameter) is an external diameter of the metal material pressure receiving surface, "C" (between-hole-wall inlet side minimum thickness size) is a porthole inlet side minimum thickness size of a between-hole-wall formed by a wall portion between a pair of adjacent portholes, "n" is the number of the between-hole-walls, and "D" is a between-hole-wall inlet side total thickness size obtained by multiplying the number "n" of the between-hole-walls by the between-hole-wall inlet side minimum thickness size "C."

15. The die case for an extrusion molding die as recited in claim 14, wherein the metal material pressure receiving surface is constituted by a convex spherical surface of a ⅙ sphere to a ⅘ sphere.

16. An extrusion molding method for metal material, comprising:

preparing a die case having a pressure receiving portion with an outer surface functioning as a metal material pressure receiving surface, wherein the die case is disposed so that the metal material pressure receiving surface faces rearward so as to oppose to an extrusion direction of the metal material; a male die mounted in the die case; and a female die mounted in the die case so as to form an extrusion hole by and between the female die and the male die;

forming the pressure receiving surface into a rearwardly protruded convex shape;

forming a plurality of metal material introducing portholes in an external periphery of the pressure receiving surface at intervals in a circumferential direction around an axial center of the die case;

adjusting B/A to 1.8 to 6.0 and D/B to 0.15 to 0.4, where "A" (product circumscribed circle diameter) is a diameter of a minimum circumscribed circle of a cross-section of an extrusion molded product, "B" (pressure receiving surface external diameter) is an external diameter of the metal material pressure receiving surface, "C" (between-hole-wall inlet side minimum thickness size) is a porthole inlet side minimum thickness size of a between-hole-wall formed by a wall portion between a pair of adjacent portholes, "n" is the number of the between-hole-walls, and "D" is a between-hole-wall inlet side total thickness size obtained by multiplying the number "n" of the between-hole-walls by the between-hole-wall inlet side minimum thickness size "C"; and introducing the metal material pressed against the metal material pressure receiving surface into the die case via the portholes to pass through the extrusion hole.

17. An extruder for metal material equipped with a container and an extrusion molding die set to the container, and configured to supply metal material in the container to the extrusion molding die, wherein the extrusion molding die comprises:

a die case having a pressure receiving portion with an outer surface functioning as a metal material pressure receiving surface, wherein the die case is disposed so that the metal material pressure receiving surface faces rearward so as to oppose to an extrusion direction of the metal material:

a male die mounted in the die case; and a female die mounted in the die case so as to form an extrusion hole by and between the female die and the male die, wherein the pressure receiving surface is formed into a rearwardly protruded convex shape, and a plurality of metal material introducing portholes are formed in an external periphery of the pressure receiving surface at intervals in a circumferential direction around an axial center of the die case, wherein it is configured such that the metal material pressed against the metal material pressure receiving surface is introduced into the die case via the portholes and passes through the extrusion hole, and wherein B/A is adjusted to 1.8 to 6.0 and D/B is adjusted to 0.15 to 0.4, where "A" (product circumscribed circle diameter) is a diameter of a minimum circumscribed circle of a cross-section of an extrusion molded product, "B" (pressure receiving surface external diameter) is an external diameter of the metal material pressure receiving surface, "C" (between-hole-wall inlet side minimum thickness size) is a porthole inlet side minimum thickness size of a between-hole-wall formed by a wall portion between a pair of adjacent portholes, "n" is the number of the between-hole-walls, and "D" is a between-hole-wall inlet side total thickness size obtained by multiplying the number "n" of the between-hole-walls by the between-hole-wall inlet side minimum thickness size "C".

* * * * *